US007909028B2

(12) United States Patent
Spurgeon

(10) Patent No.: US 7,909,028 B2
(45) Date of Patent: Mar. 22, 2011

(54) INLAID STONE COMPOSITE

(75) Inventor: Daniel A. Spurgeon, Raytown, MO (US)

(73) Assignee: Sierra Granite Holdings LLC, Raytown, MO (US)

( * ) Notice: Subject to any disclaimer, the term of this patent is extended or adjusted under 35 U.S.C. 154(b) by 0 days.

(21) Appl. No.: 11/953,168

(22) Filed: Dec. 10, 2007

(65) Prior Publication Data

US 2009/0145415 A1 Jun. 11, 2009

(51) Int. Cl.
*B28D 1/04* (2006.01)

(52) U.S. Cl. ..... 125/13.01

(58) Field of Classification Search ..... 125/13.01
See application file for complete search history.

(56) References Cited

U.S. PATENT DOCUMENTS

| | | | | |
|---|---|---|---|---|
| 1,396,554 | A | | 11/1921 | Breese |
| 1,485,810 | A | | 3/1924 | Parker, Jr., et al. |
| 2,037,294 | A | | 4/1936 | Williamson |
| 3,077,012 | A | | 2/1963 | Speraw |
| 3,343,645 | A | | 9/1967 | Doerfling |
| 3,511,738 | A | | 5/1970 | McGuire |
| 3,623,599 | A | | 11/1971 | Tillman |
| 3,647,043 | A | | 3/1972 | Garetto |
| 3,740,513 | A | | 6/1973 | Peters, Jr. et al. |
| 3,842,488 | A | | 10/1974 | Mitchell |
| 3,878,030 | A | | 4/1975 | Cook |
| 3,950,202 | A | | 4/1976 | Hodges |
| 4,139,882 | A | | 2/1979 | Schneider |
| 4,253,559 | A | | 3/1981 | Myers et al. |
| 4,257,513 | A | | 3/1981 | Siarto |
| 4,333,288 | A | * | 6/1982 | Coombs ..... 52/312 |
| 4,570,782 | A | | 2/1986 | Cargill et al. |
| 4,640,850 | A | | 2/1987 | Marocco |
| 4,640,947 | A | | 2/1987 | Berg et al. |
| 4,814,220 | A | | 3/1989 | Brathwaite |
| 4,822,661 | A | | 4/1989 | Battaglia |
| 4,843,524 | A | | 6/1989 | Krent et al. |
| 4,931,331 | A | | 6/1990 | Owens |
| 4,940,000 | A | | 7/1990 | Horvath et al. |
| 4,956,030 | A | | 9/1990 | Baskin |
| 5,075,254 | A | | 12/1991 | Robinson et al. |
| 5,085,027 | A | | 2/1992 | McClung et al. |

(Continued)

FOREIGN PATENT DOCUMENTS

DE 3310281 A1 10/1984

OTHER PUBLICATIONS

Benissimo Systems, "Benissimo Systems," from website www.benissimosystems.com (printed Apr. 17, 2009).

(Continued)

*Primary Examiner* — Maurina Rachuba
(74) *Attorney, Agent, or Firm* — Hovey Williams LLP

(57) ABSTRACT

An inlaid stone composite broadly includes a body stone and an inlay stone secured within a groove of the body stone, with the inlaid stone composite presenting a finished layered edge surface, and with the surface having a longitudinally extending edge profile. The inlaid stone composite is manufactured using a stone machine tool that includes, among other things, powered assemblies for machining the groove, machining the profile, and for polishing the profile. The body stone and inlay stone are machined to close tolerances so that the stones include respective surfaces in abutting engagement with one another. The stones are further machined to limit chipping of the composite.

18 Claims, 22 Drawing Sheets

U.S. PATENT DOCUMENTS

| | | | | |
|---|---|---|---|---|
| 5,157,891 | A | 10/1992 | Nelson | |
| 5,208,086 | A | 5/1993 | Owens | |
| 5,253,932 | A | 10/1993 | Nesovic | |
| 5,273,620 | A * | 12/1993 | Lamberti | 216/30 |
| 5,286,290 | A | 2/1994 | Risley | |
| 5,310,435 | A | 5/1994 | Kelly | |
| 5,330,262 | A * | 7/1994 | Peters | 312/140.4 |
| 5,364,672 | A | 11/1994 | Schultze-Kraft | |
| 5,452,666 | A * | 9/1995 | Peters | 108/27 |
| 5,469,685 | A | 11/1995 | Nelson | |
| 5,476,895 | A | 12/1995 | Ghahary | |
| 5,536,345 | A | 7/1996 | Lingart | |
| 5,613,342 | A | 3/1997 | Nelson | |
| 5,640,947 | A | 6/1997 | Shute | |
| 5,670,007 | A | 9/1997 | Toncelli | |
| 5,697,413 | A | 12/1997 | Fuller | |
| 5,709,453 | A | 1/1998 | Krent et al. | |
| 5,787,667 | A | 8/1998 | Sheahan et al. | |
| 5,789,032 | A | 8/1998 | Le Cong et al. | |
| 5,792,524 | A | 8/1998 | Lingart et al. | |
| 5,797,238 | A | 8/1998 | Berntsson et al. | |
| 6,006,735 | A | 12/1999 | Schlough et al. | |
| 6,179,434 | B1 | 1/2001 | Saraiji | |
| 6,183,585 | B1 | 2/2001 | Kelley | |
| 6,205,727 | B1 | 3/2001 | Toncelli | |
| 6,258,190 | B1 | 7/2001 | Sciarrino et al. | |
| 6,286,577 | B1 * | 9/2001 | Douglas et al. | 156/512 |
| 6,378,257 | B1 | 4/2002 | Guerri | |
| 6,413,337 | B2 | 7/2002 | Sciarrino et al. | |
| 6,478,135 | B1 | 11/2002 | Coakley et al. | |
| 6,517,897 | B1 | 2/2003 | Bordener | |
| 6,547,419 | B1 | 4/2003 | Brackman | |
| 6,772,748 | B2 * | 8/2004 | Cleary | 125/1 |
| 6,792,934 | B2 | 9/2004 | Benyovits | |
| 6,886,304 | B1 | 5/2005 | Godi et al. | |
| 6,945,006 | B2 | 9/2005 | Stoffer | |
| 6,958,367 | B2 | 10/2005 | Milic et al. | |
| 7,021,786 | B1 | 4/2006 | Sandor, Sr. | |
| 7,090,380 | B2 | 8/2006 | Gerfers, III | |
| 7,094,136 | B2 | 8/2006 | Nomoto et al. | |
| 7,166,369 | B2 | 1/2007 | Sturley | |
| 7,182,080 | B1 | 2/2007 | O'Neal | |
| 7,221,104 | B2 | 5/2007 | Lys et al. | |
| 7,229,203 | B2 | 6/2007 | Lath | |
| 7,374,472 | B2 * | 5/2008 | Zheng | 451/28 |
| 2002/0006313 | A1 | 1/2002 | Pas | |
| 2002/0124525 | A1 | 9/2002 | Stoffer | |
| 2003/0047176 | A1 | 3/2003 | Benyovits | |
| 2003/0070670 | A1 * | 4/2003 | Cleary | 125/1 |
| 2003/0070671 | A1 * | 4/2003 | Cleary | 125/1 |
| 2004/0150306 | A1 | 8/2004 | Steedly | |
| 2004/0213946 | A1 | 10/2004 | Miller | |
| 2004/0228144 | A1 | 11/2004 | Squicciarini | |
| 2005/0006379 | A1 | 1/2005 | Sullivan | |
| 2005/0035693 | A1 | 2/2005 | Reamer | |
| 2005/0073224 | A1 | 4/2005 | Livingston et al. | |
| 2006/0154015 | A1 | 7/2006 | Miller et al. | |
| 2006/0179791 | A1 | 8/2006 | Shaw | |
| 2006/0198128 | A1 | 9/2006 | Piepgras et al. | |
| 2006/0217044 | A1 | 9/2006 | Volponi | |
| 2007/0003791 | A1 | 1/2007 | Rochette | |

OTHER PUBLICATIONS

Alibaba.com Corp, "Jiangxi Hongtai Industry Group Co., Inc.," from website www.hongtai.en.alibaba.com (printed Mar. 28, 2007).

Marblemaster, "Microthin Granite Panels," from website www.marblemaster.com (printed Mar. 28, 2007).

Amana Tool, "Vertical Raised Panel," from website www.amanatool.com (printed Mar. 31, 2007).

Lyman Associates, Inc., "Home Page," from website www.lymanassociates.com (printed Mar. 31, 2007).

Auto 'V' Grooving, Inc. "Auto 'V' Grooving Inc.," from website www.vgrooving.com, (printed Apr. 1, 2007).

Auto 'V' Grooving Inc., "ST-SS-2-FT Automatic Lineal "V" Groover for Natural and Engineered Stone Plus Solid Surface," from web site www.vgrooving.com (printed Apr. 1, 2007).

Joe Dowd, Countertop Innovation Takes Firm to New Level, Kitchen and Bath Dasign News: Jan. 2007; at 38, 40.

SEClay, About Precision Stone Inlays at http://www.seclay.com/aboutinlays/aboutinlays.htm (dated Oct. 2, 2007) .

SEClay, Cabinetry at http://www.seclay.com/cabinetry/cab.htm (dated Oct. 2, 2007).

SEClay, Inlay Catalog at http://www.seclay.com/catalog/cat (dated Oct. 2, 2007).

Prussiani Engineering, General Catalog at 24 (dated Oct. 2007).

Granquartz, Stone Tools and Equipment Catalog vol. 2 at 44 (dated 2007).

* cited by examiner

INLAID STONE COMPOSITE

BACKGROUND

1. Field

The present invention relates generally to man-made stone structures. More specifically, embodiments of the present invention concern an inlaid stone composite having a body stone and an inlay stone secured to the body stone.

2. Discussion of Prior Art

The use of various stone materials, such as granite, marble, or quartz, for residential or commercial installations, e.g, for kitchen countertops, is well known in the art. Natural granite is desirable for such applications because of several attributes, e.g, its resistance to scratching, resistance to damage from extreme heat, and its luxurious appearance. Furthermore, it is also known in the art to use engineered stone type materials, which include finely ground stone particles or dust, for such applications. Whether natural or man-made, stone is commonly machined and polished by powered machines to provide the stone with polished and flat surfaces while also providing a desired edge shape.

Prior art stone building products and associated manufacturing methods are problematic and suffer from various undesirable limitations. For instance, prior art methods are deficient when it comes to combining stone layers to present an attractive stone composite panel. In particular, prior art methods require the use of backing material to form a panel with thin layers or veneers of stone while avoiding breakage of the stone layers. Furthermore, prior art machining methods cause excessive and undesirable chipping of stone, particularly when very thin stone layers are being machined.

SUMMARY

The present invention provides an inlaid stone composite that does not suffer from the problems and limitations of the prior art products and methods set forth above.

A first aspect of the present invention concerns a method of manufacturing an inlaid stone composite having at least two stone layers. The method broadly includes the steps of forming an elongated groove in a first one of the stone layers, with the groove extending inwardly from a first edge surface of the first stone layer; securing a second one of the stone layers within the elongated groove to form an inlaid margin that includes the layers, with the second layer presenting a second edge surface positioned adjacent the first edge surface; and machining the layers at the same time to remove part of the margin and thereby form a finished layered edge surface.

A second aspect of the present invention concerns an inlaid stone composite having an elongated inlaid margin configured to be finished by a machine. The inlaid stone composite broadly includes a stone body, an elongated stone inlay, and adhesive. The stone body presents an elongated body edge surface and a longitudinally extending groove that intersects and extends inwardly from the surface. The body presents opposed longitudinally extending groove interior side surfaces that at least partly define the groove. The elongated stone inlay is positioned within the groove and presents an inlay edge surface and longitudinally extending opposite side surfaces, with the edge surfaces cooperatively forming a finished layered edge surface. The adhesive is positioned between and bonds abutting pairs of side surfaces to one another to thereby secure the inlay to the body. The abutting pairs of side surfaces are in frictional engagement with one another so that the stone inlay and the groove are substantially complementally shaped, with the finished layered edge surface being formed by the machine after the inlay is secured in the body by removing part of the inlaid margin.

A third aspect of the present invention concerns a circular stone-cutting tool configured to be attached to a powered mandrel, and thereby rotatable by the mandrel to machine a rectangular-shaped groove having a groove width. The stone-cutting tool broadly includes a rotatable diamond-tipped blade assembly. The blade assembly presents an arcuate outermost blade perimeter with a number of notches spaced substantially uniformly along the perimeter, with the blade assembly defining edge segments spaced between respective pairs of adjacent notches. The blade assembly has a width that is configured to substantially correspond to the groove width. The edge segments have a substantially common segment length. The notches have a substantially common notch length, with each segment length being longer than the notch length and with the notch length being shorter than the blade assembly width.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 34:
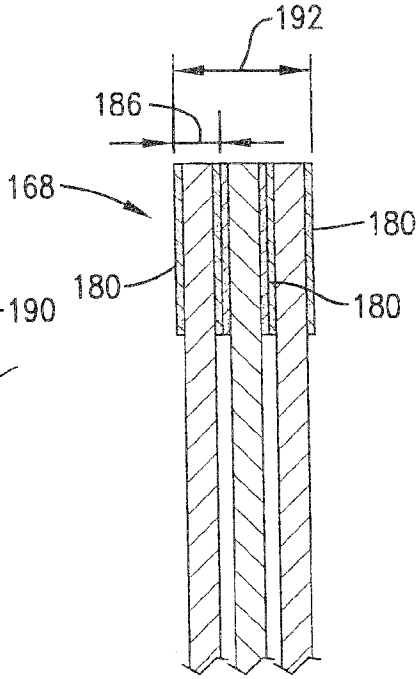
FIG. 34 is a fragmentary cross-sectional view of the blade assembly shown in FIG. 33.
Figure 34A:
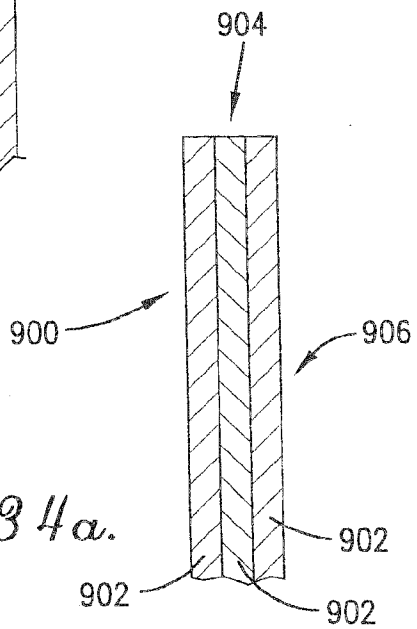
Figure 33:
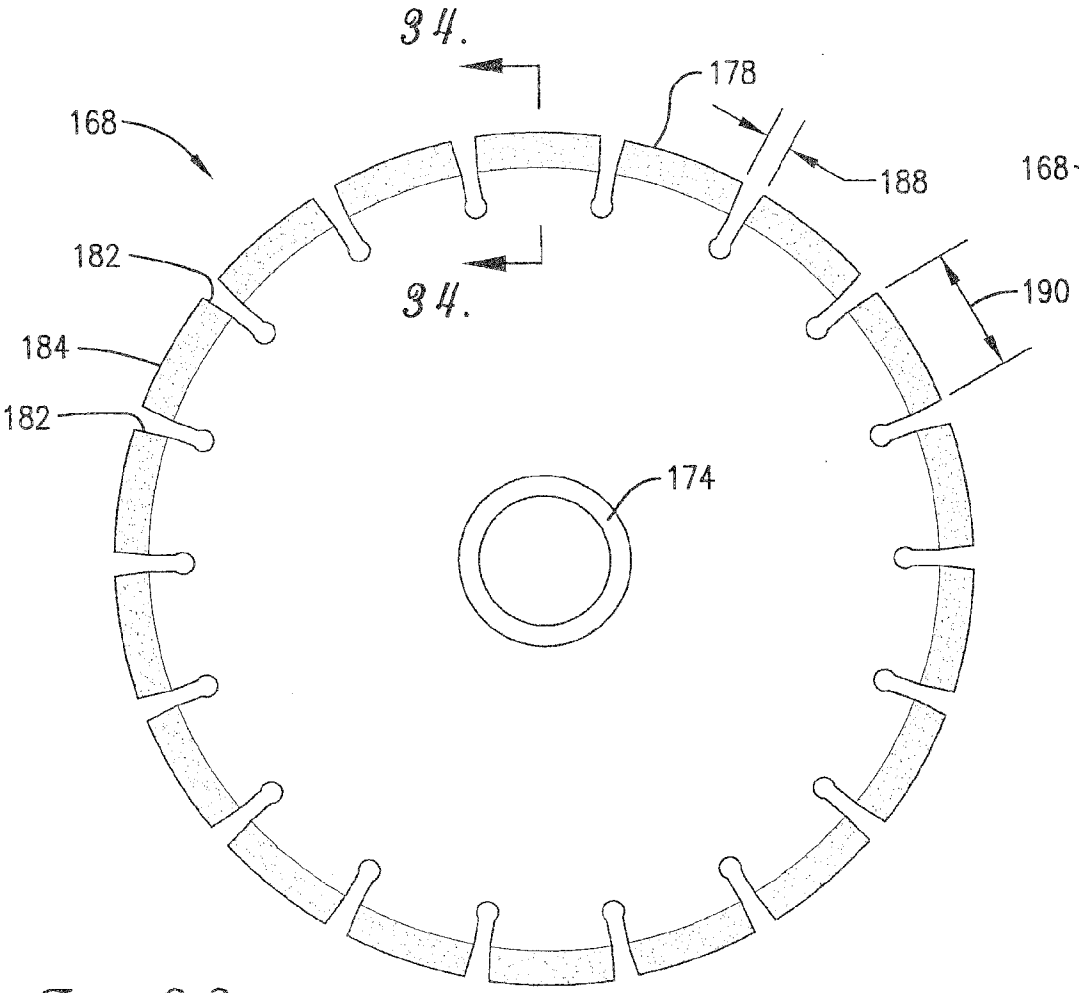
FIG. 33 is an elevational view of the blade assembly shown in FIGS. 9-12.
Figure 36:
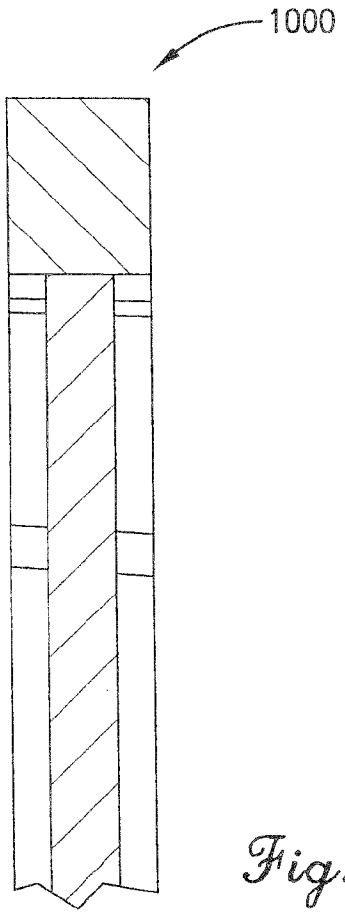
Figure 35:
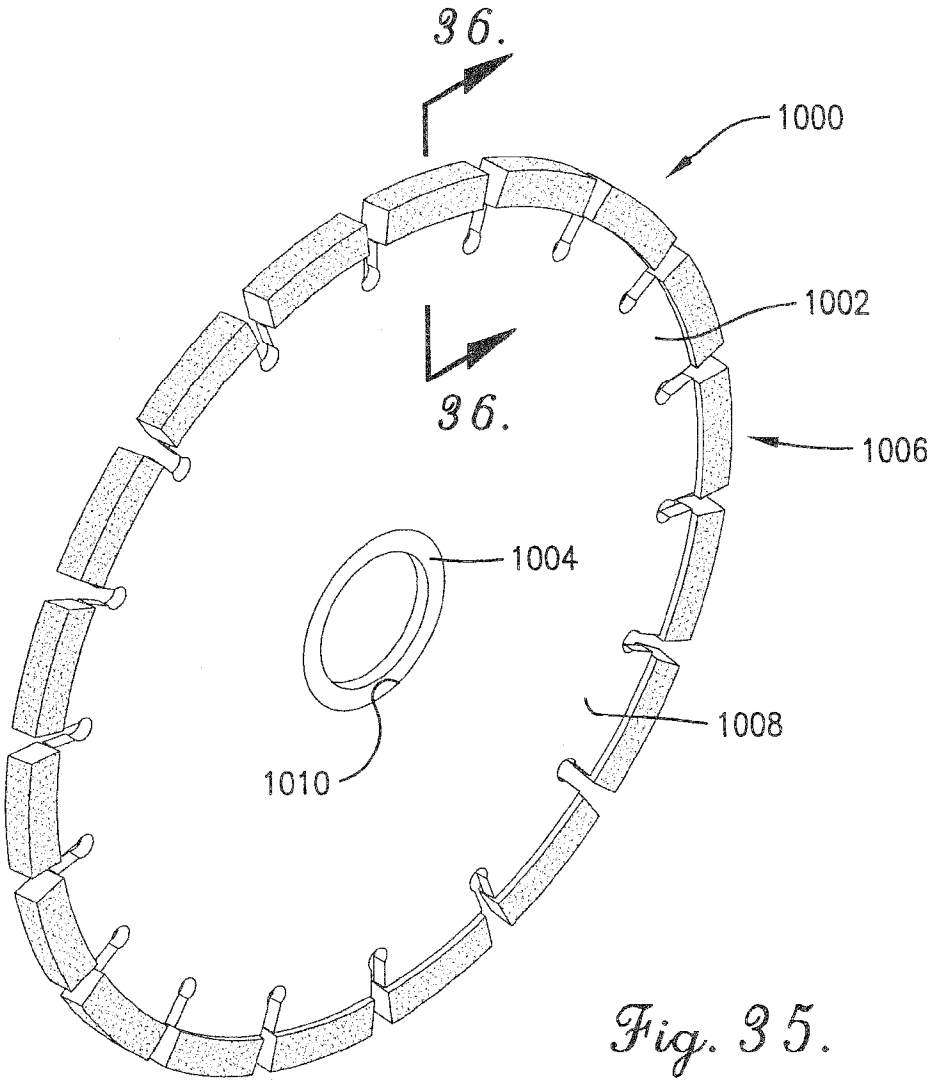

FIG. 34*a* is a fragmentary cross-sectional view of a blade assembly constructed in accordance with an eighth embodiment of the present invention;

FIG. 35 is a perspective view of a blade assembly constructed in accordance with a ninth embodiment of the present invention; and FIG. 36 is a fragmentary cross-sectional view of the blade assembly shown in FIG. 35.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
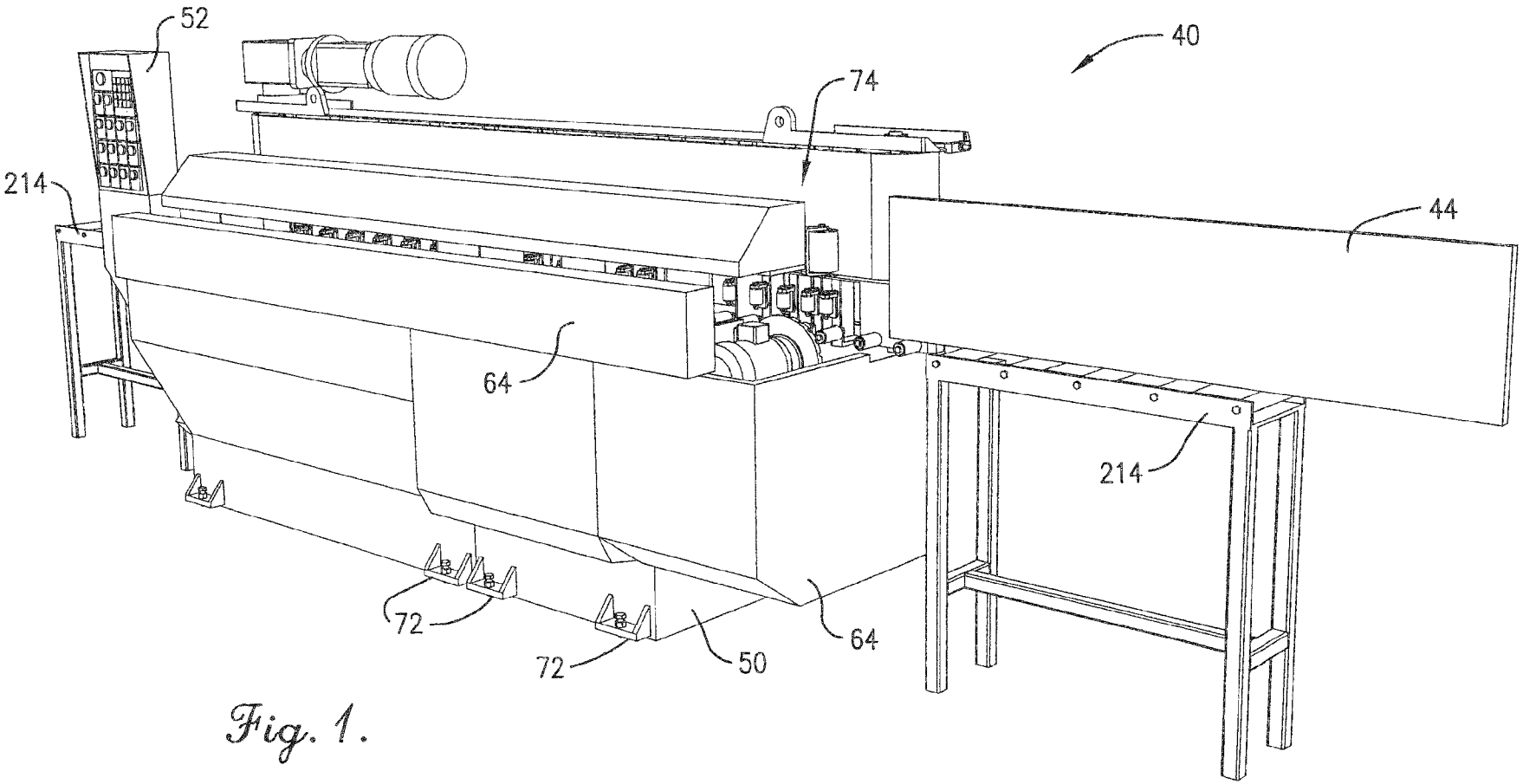
FIG. 1 is a right side perspective view of a stone machining tool constructed in accordance with a first embodiment of the present invention.
Figure 2:
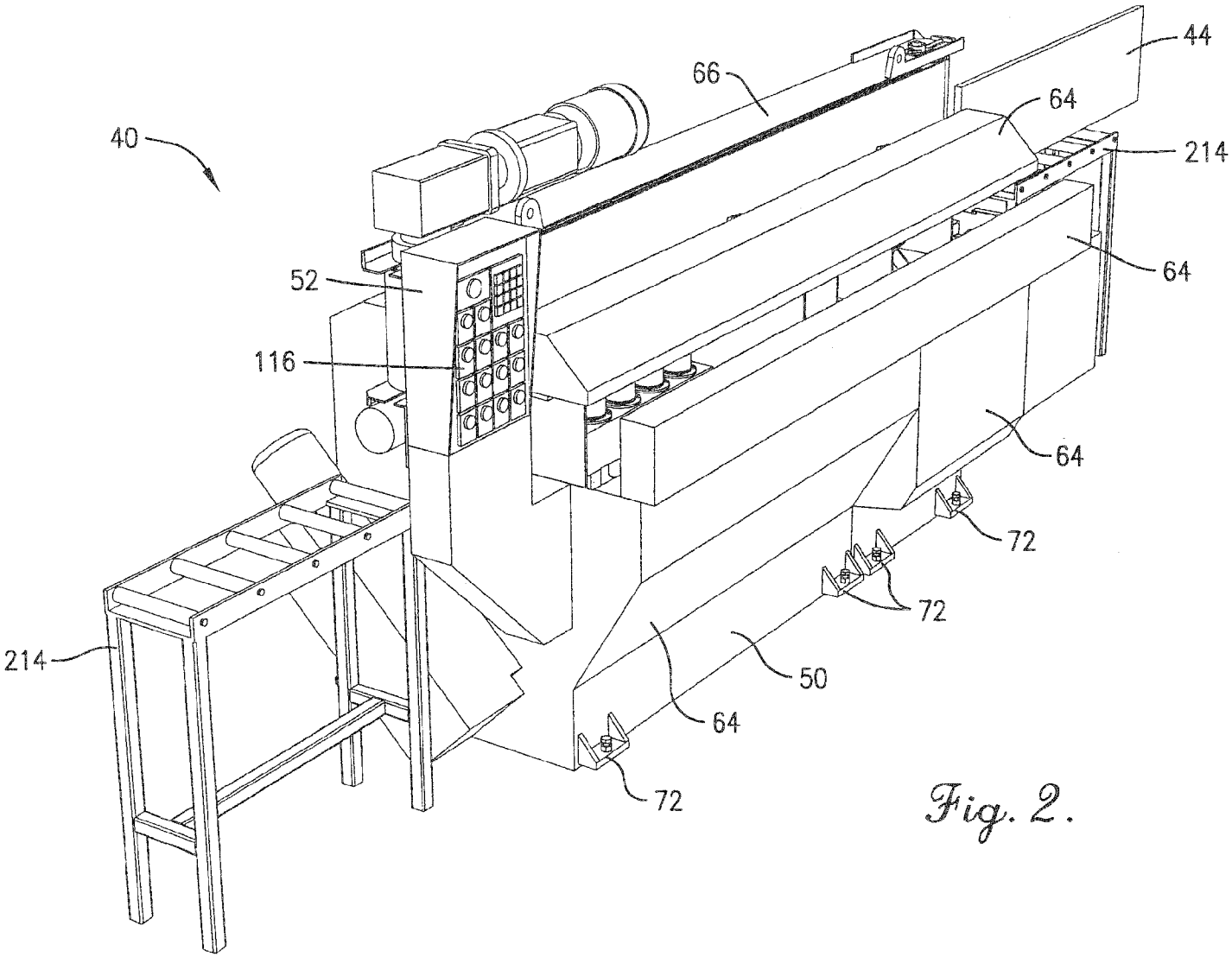
FIG. 2 is a left side perspective view of the stone machining tool shown in FIG. 1.
Figure 3:
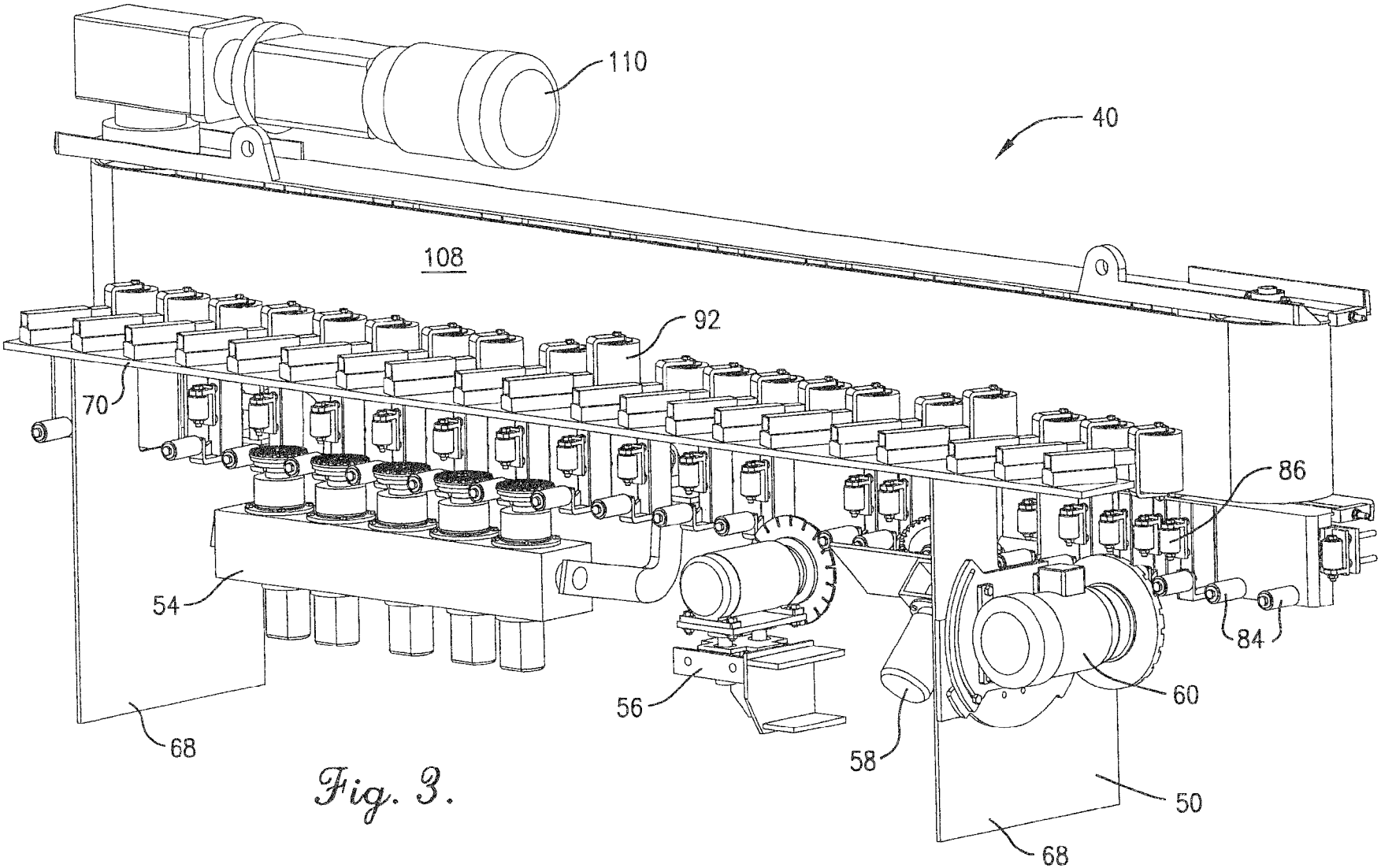
FIG. 3 is a fragmentary right side perspective view of the stone machining tool shown in FIGS. 1 and 2, showing a machine chassis, a calibrating assembly, a chamfering assembly, a shaping assembly, and a polishing assembly.
Figure 4:
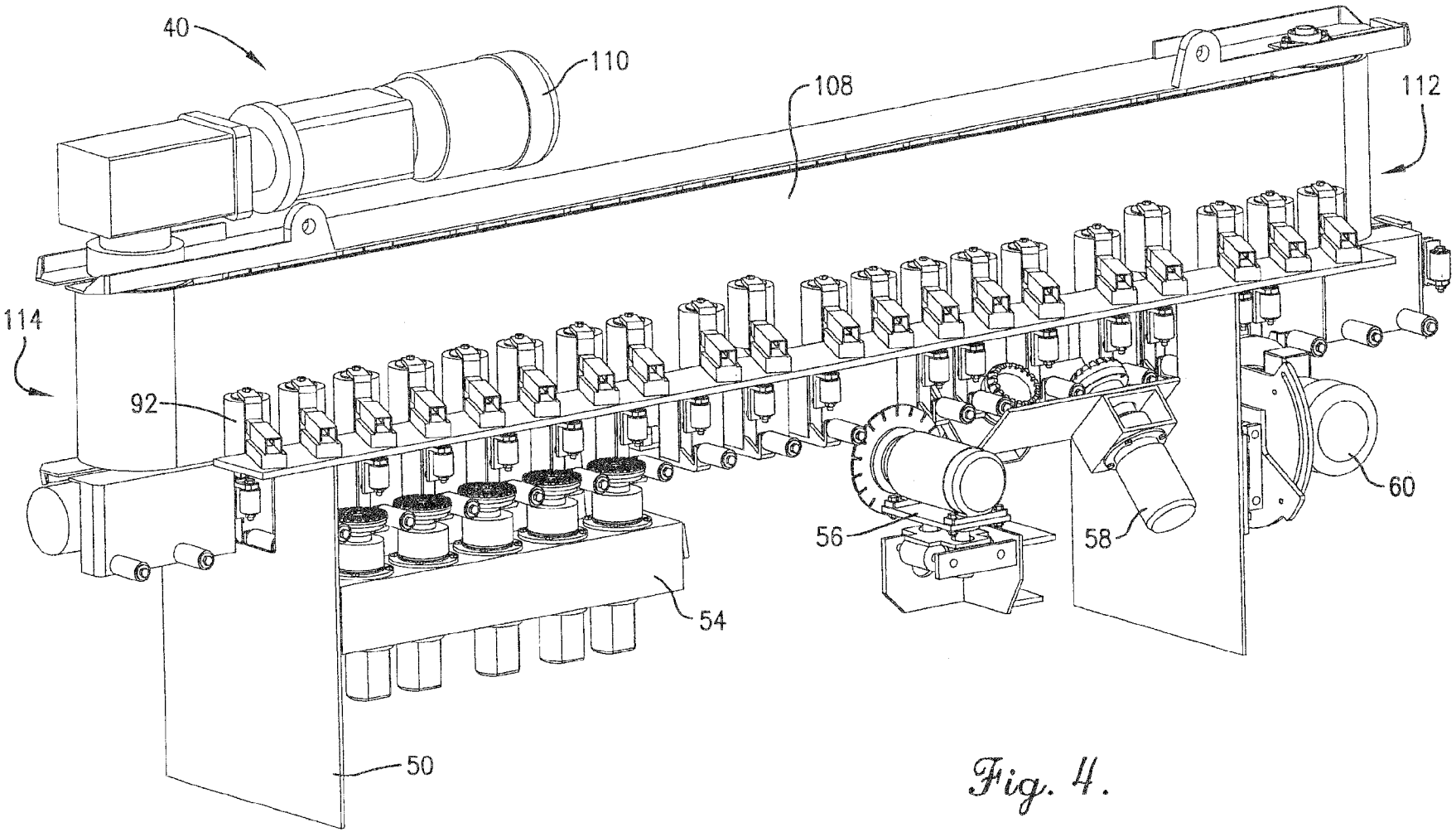
FIG. 4 is a fragmentary left side perspective view of the stone machining tool shown in FIGS. 1-3.
Figure 5:
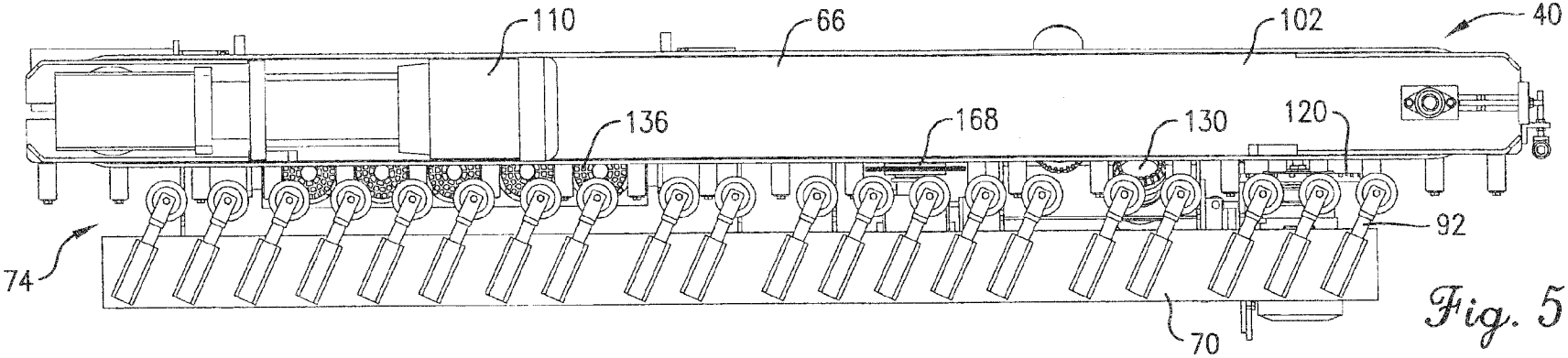
FIG. 5 is a fragmentary top view of the stone machining tool shown in FIGS. 1-4.
Figure 26:
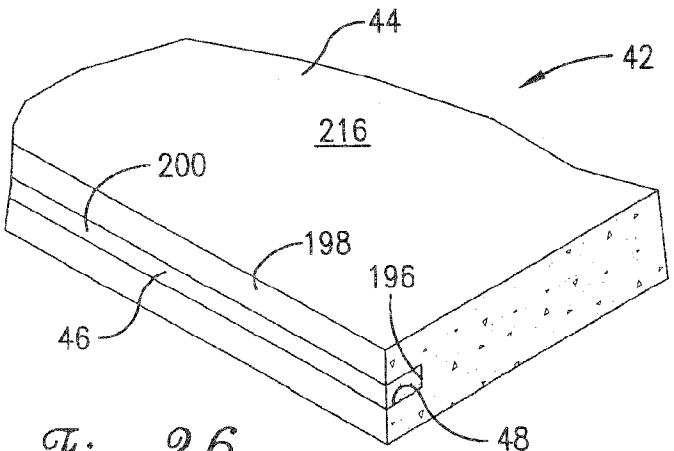
FIG. 26 is a fragmentary perspective view of the inlaid stone composite shown in FIGS. 24 and 25, showing the excess portion of the stone inlay being removed and the inlaid stone composite polished to form a flat polish profile.

Turning initially to FIGS. 1, 2 and 26, a stone machining tool 40 is operable to machine a stone panel 42 including a body stone 44 and an inlay stone 46. As will be discussed in greater detail, the body stone 44 presents a groove 48 that is configured to receive the inlay stone 46. Preferably, the stone panel 42 is made from natural granite, with the body stone 44 comprising one type of granite and the inlay stone 46 comprising another type of granite. However, the principles of the present invention are equally applicable where other types of natural or man-made stone materials are used. For instance, the stone panel 42 may include one or more of various natural stone materials such as marble, quartz, slate, limestone, sandstone, or onyx that are quarried and pre-cut into stone sheets. Such naturally-occurring stones typically exhibit anisotropic physical properties, but these materials generally have a density in the range of about 100 pounds/foot to about 200 pounds/foot, a compressive strength in the range of about 2000 to about 60,000 psi, and a shear strength of about 300 to about 7000 psi. Natural stones also typically have very low tensile strength. Various man-made stone materials that include stone particles mixed with another material such as a thermoplastic material may also be included in the stone panel 42. Examples of such man-made stone materials include Silestone®, Zodiaq®, Cambria®, Caesarstone®, and Avonite™.

While the stone panel 42 is preferably used in the illustrated whole form, it is also within the ambit of the present invention where the panel 42 is subsequently trimmed, e.g., to use only a portion of the panel 42 in a given application. Furthermore, the stone panel 42 is configured for use in various kitchen or furniture applications, e.g., as a countertop, a door, cabinet structure, trim, chair rail, or crown molding. Also, the illustrated body stone 44 is preferably unitary and preferably includes a substantially constant thickness, but it is also consistent with the principles of the present invention where the body stone 44 includes multiple pieces or components. The stone panel 42 preferably presents a panel thickness in the range of about one (1) centimeter to about one (1) foot, but it is within the scope of the present invention to have a panel thickness outside of this range.

Turning to FIGS. 1-6, the preferred machining tool 40 is designated as Automatic Vertical Edge Polishing Machine, Model LCT 522 CAI, manufactured by Marmo Meccanica SPA of Jesi, Italy. However, it is within the ambit of the present invention where other types of stone machining tools are used to machine the stone panel 42. For instance, a computer controlled multi-axis machine could be used to machine the stone panel 42 and additionally would be suitable for machining multiple non-coaxial edges on a single stone piece or a panel edge that is not straight, e.g., the endless edge of a rounded tabletop. The illustrated machining tool 40 is preferably used to shape and polish the stone panel 42. The stone machining tool 40 broadly includes a chassis 50, a controller 52, a polishing assembly 54, a shaping assembly 56, a chamfering assembly 58, and a calibrating assembly 60.

The chassis 50 is operable to support the remainder of the machining tool 40 and to support the stone panel 42 during operation. The chassis 50 includes a frame 62, sheet metal covers 64 removably attached to the frame 62, and a panel conveying assembly 66. The frame 62 is substantially rigid and includes upright bulkheads 68 and a lateral support 70 that are interconnected with one another. The frame 62 also includes feet 72 for bolting the machining tool 40 to a floor (not shown).

As will be discussed further, the chassis 50 presents a longitudinal trough 74 that is operable to receive the stone panel 42 for machining. The frame 62 and covers 64 cooperatively present a number of bays 76,78,80,82 spaced along the longitudinal trough 74 for respectively receiving the polishing assembly 54, the shaping assembly 56, the chamfering assembly 58, and the calibrating assembly 60.

The frame 62 further includes fixed lateral roller assemblies 84 and fixed upright roller assemblies 86 for supporting the panel 42 during machine operation. The lateral roller assemblies 84 are spaced along and cooperatively define a lowermost margin of the trough 74. The upright roller assemblies 86 are spaced along and cooperatively define a side margin of the trough 74. The assemblies 84,86 each include a bracket 88 and a roller 90 that is pivotally attached to the bracket 88 by a fastener. The bracket 88 is attached to the frame 62 with additional fasteners.

The frame 62 also includes shiftable roller assemblies 92 for supporting the panel 42 during machine operation. Each roller assembly 92 includes a U-shaped roller bracket 94 and a roller 96 pivotally attached to the bracket 94. Each roller assembly 92 also includes inner and outer telescopic tubes 98,100, with the inner tube 98 being fixed to the bracket 94 and the outer tube 100 being fixed to the support 70. The tubes 98,100 are interconnected by a spring (not shown) to urge the inner tube 98 in a direction outwardly from the outer tube 100. The shiftable roller assemblies 92 are spaced along a side of the trough 74 opposite the conveying assembly 66 and urge the panel 42 into contact with the conveying assembly 66. In this manner, the roller assemblies 92 cooperate with the conveying assembly 66 to preferably maintain the panel 42 in an upright position during operation.

The panel conveying assembly 66 includes a conveyor frame 102 that pivotally supports opposite drums 104,106, with the drums 104,106 receiving an endless conveyor belt 108 thereon. The panel conveying assembly 66 also includes a conveyor drive 110 mounted on the conveyor frame 102 and drivingly connected to the drum 104, with the drum 104 being operable to power the endless conveyor belt 108. Preferably, the belt 108 is configured to be rotated at a speed that ranges from about six (6) meters per hour to about thirty (30) meters per hour. More preferably, the belt 108 is rotated at a speed of about eight (8) meters per hour. The belt 108 is powered to normally move the panel 42 from an entry end 112 of the trough 74 to an exit end 114 of the trough 74. The belt 108 and the upright roller assemblies 86 cooperatively define an upright plane along which the belt 108 and upright roller assemblies 86 support the panel 42. In other words, the conveying assembly 66 serves to keep the panel 42 aligned along the upright plane. Furthermore, the upright plane serves as a datum for setting the position of the various machining assemblies 54,56,58,60 relative to the chassis 50.

The controller 52 is positioned adjacent the exit end 114 of the chassis 50 and serves to control operation of the machining tool 40. The controller 52 includes, among other things, a console 116 that provides an interface for controlling the conveying assembly 66, as well as the polishing assembly 54, the shaping assembly 56, the chamfering assembly 58, and the calibrating assembly 60.

Turning to FIGS. 5-8, the calibrating assembly 60 is positioned adjacent the entry end 112 and within bay 82. The calibrating assembly 60 includes a motor 118 and a calibrating wheel 120 drivingly attached to a mandrel of the motor 118. The motor 118 is shiftably attached to the frame 62 by a bracket assembly 122 and is thereby operable to be selectively positioned relative to the trough 74. More particularly, the bracket assembly 122 includes a fixed bracket 124 and a movable bracket 126 that pivots relative to the fixed bracket 124 about a pivot axis (not shown) through an angle of about ninety degrees. Thus, the calibrating wheel 120 can be positioned with a rotational axis thereof extending laterally as illustrated, with the rotational axis being substantially perpendicular to the upright datum plane. But the calibrating wheel 120 can also be pivoted about the pivot axis so that the rotational axis is substantially parallel to or in another non-perpendicular position relative to the datum plane. The bracket assembly 122 includes linear bearings (not shown) that permit lateral movement of the movable bracket 126 along an axis normal to the upright datum plane and vertical movement along a vertical axis that is parallel to the upright datum plane. Thus, the calibrating wheel 122 can also be shifted laterally and vertically into and out of the trough 74. The calibrating wheel 122 preferably has a diameter of about 25 cm, but could be larger or smaller. Preferably, the motor 118 is operable to rotate the calibrating wheel 122 at a speed of about 1400 rpm, but an alternative speed can be used without departing from the scope of the present invention.

Figure 6:
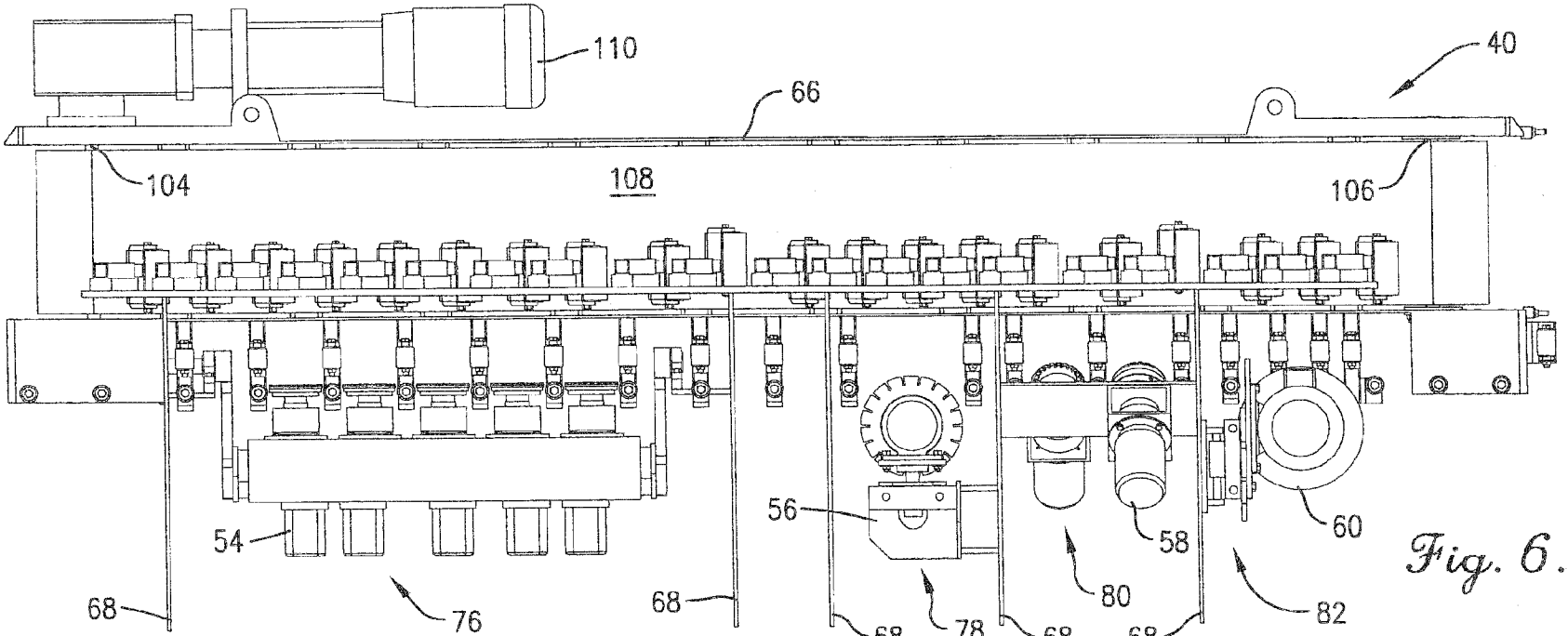
FIG. 6 is a fragmentary elevational view of the stone machining tool shown in FIGS. 1-5.
Figure 17:
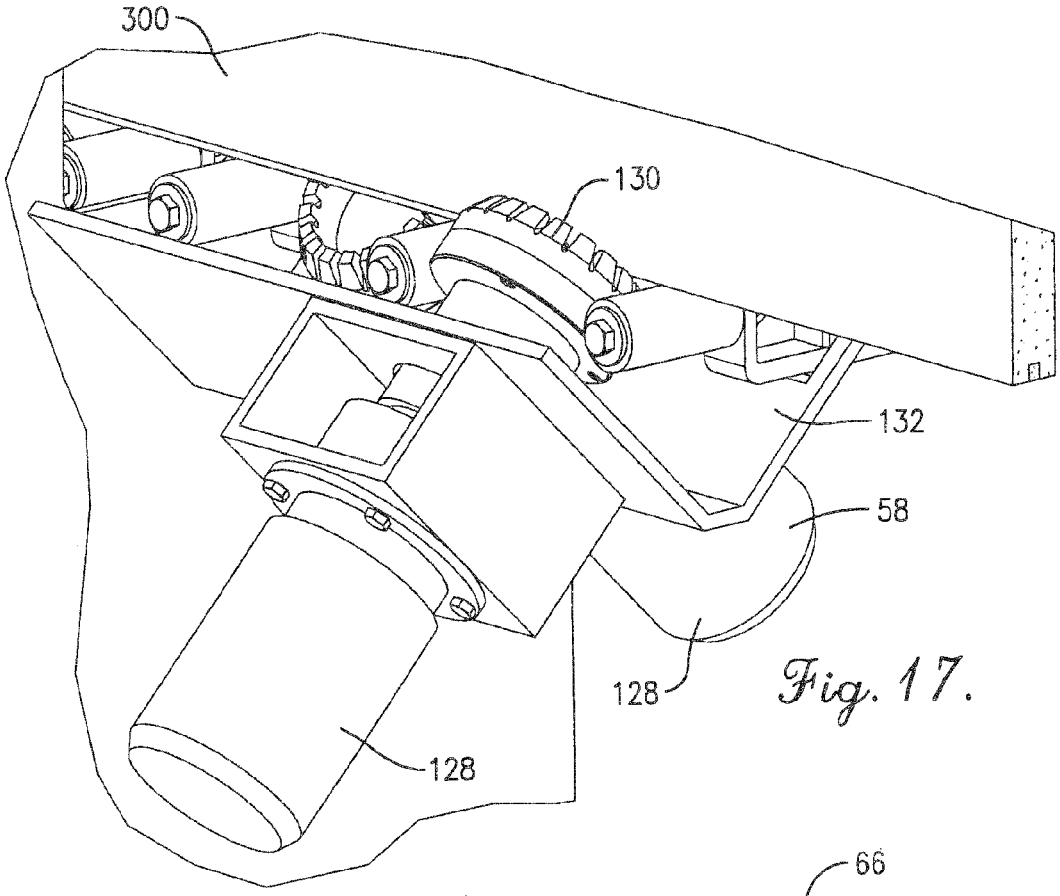
FIG. 17 is an enlarged fragmentary perspective view of the stone machining tool shown in FIGS. 1-6, showing an inlaid stone composite being machined by the chamfering assembly to form a chamfered profile.
Figure 18:
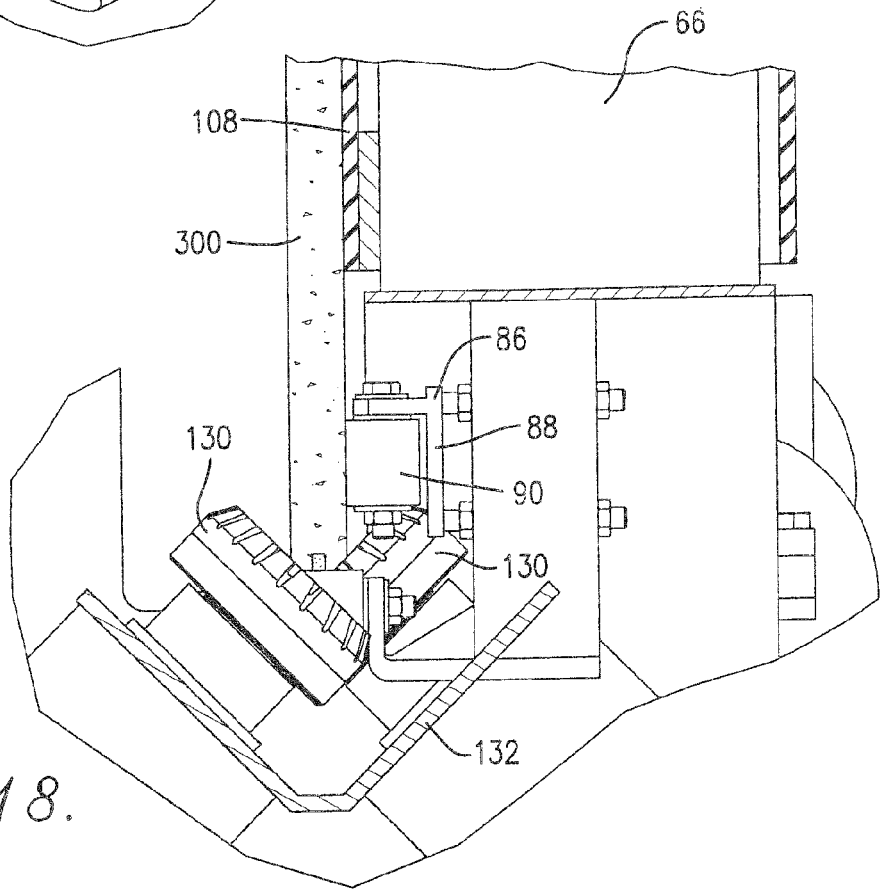
FIG. 18 is an enlarged fragmentary end elevational view of the stone machining tool shown in FIG. 17.

Turning to FIGS. 6, 17, and 18, the chamfering assembly 58 is positioned within bay 80 and includes a pair of motors 128 and a pair of chamfering wheels 130 drivingly attached to respective motors 128. The motors 128 are attached to the frame 62 by a bracket assembly 132. The wheels 130 are preferably positioned so that the rotational axes of the wheels 130 are substantially perpendicular to one another. Furthermore, the wheels 130 are preferably positioned so that the rotational axes are angularly offset from the upright datum plane at an angle of about 45 degrees when measured about a lateral axis extending parallel to the datum plane. However, the wheels 130 could be alternatively positioned relative to one another or relative to the upright datum plane without departing from the scope of the present invention. The chamfering wheels 130 are positionable along a vertical direction for movement into and out of the trough 74 by a pneumatic actuator (not shown).

Turning to FIGS. 14-16, 22, and 23, the polishing assembly 54 is positioned within bay 76 and includes motors 134 and polishing wheels 136 each drivingly attached to a mandrel of the respective motor 134. The motors 134 are mounted in a shiftable mounting block 138 so as to be fixed relative to one another. The shiftable mounting block 138 is attached to the frame 62 by a pivotal linkage 140 and by bearings 142. As will be discussed further, the linkage 140 permits the mounting block 138 to rotate through an angle of about 172 degrees.

Figure 20:
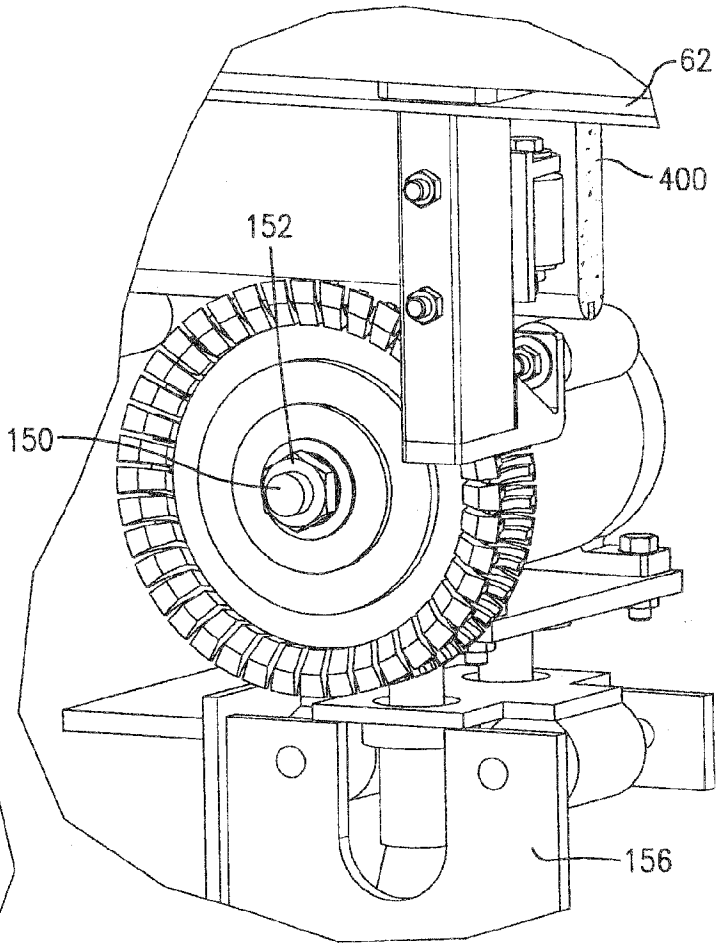
FIG. 20 is an enlarged fragmentary rear perspective view of the stone machining tool shown in FIG. 19.
Figure 19:
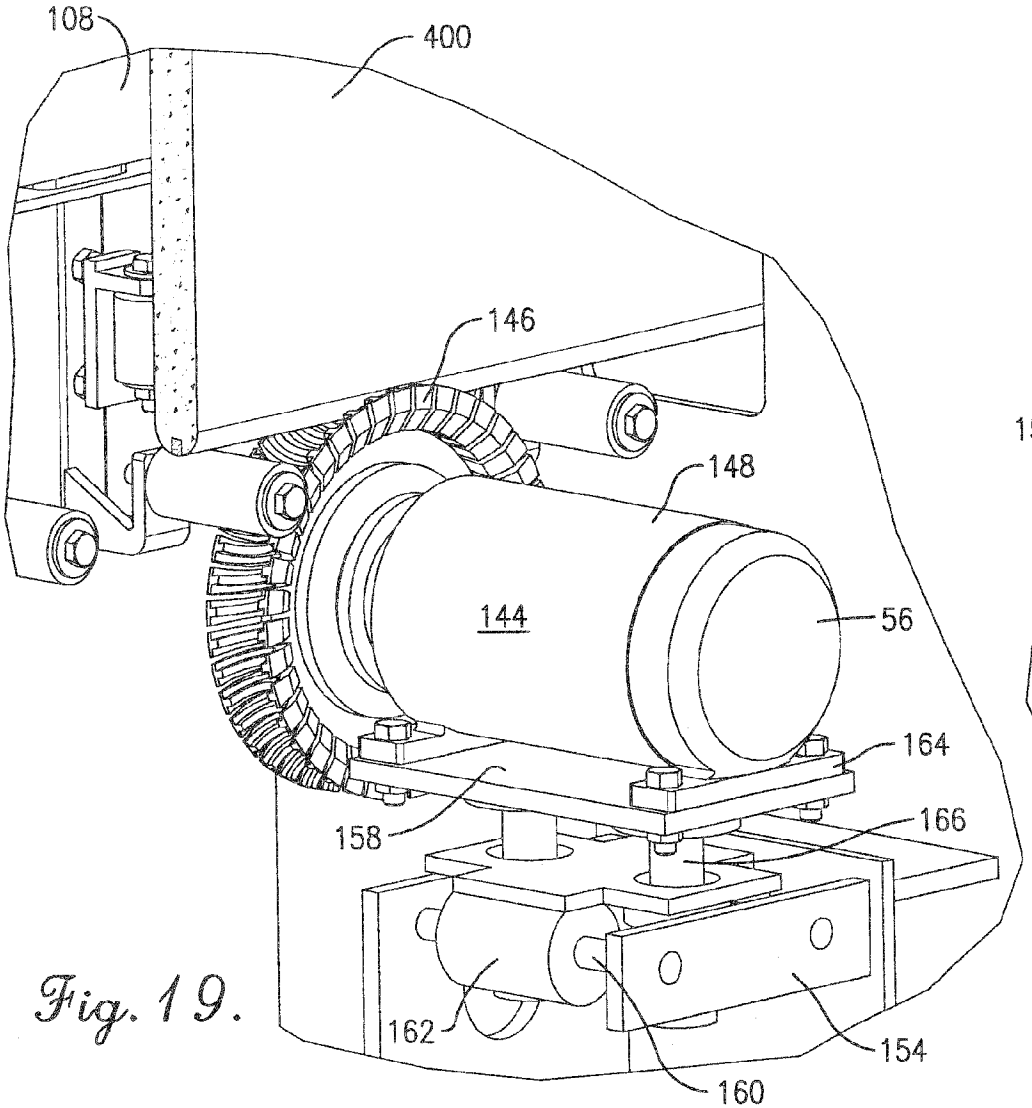
FIG. 19 is an enlarged fragmentary front perspective view of the stone machining tool shown in FIGS. 1-6, showing an inlaid stone composite being machined by the shaping assembly to form a bull nose profile.
Figure 21:
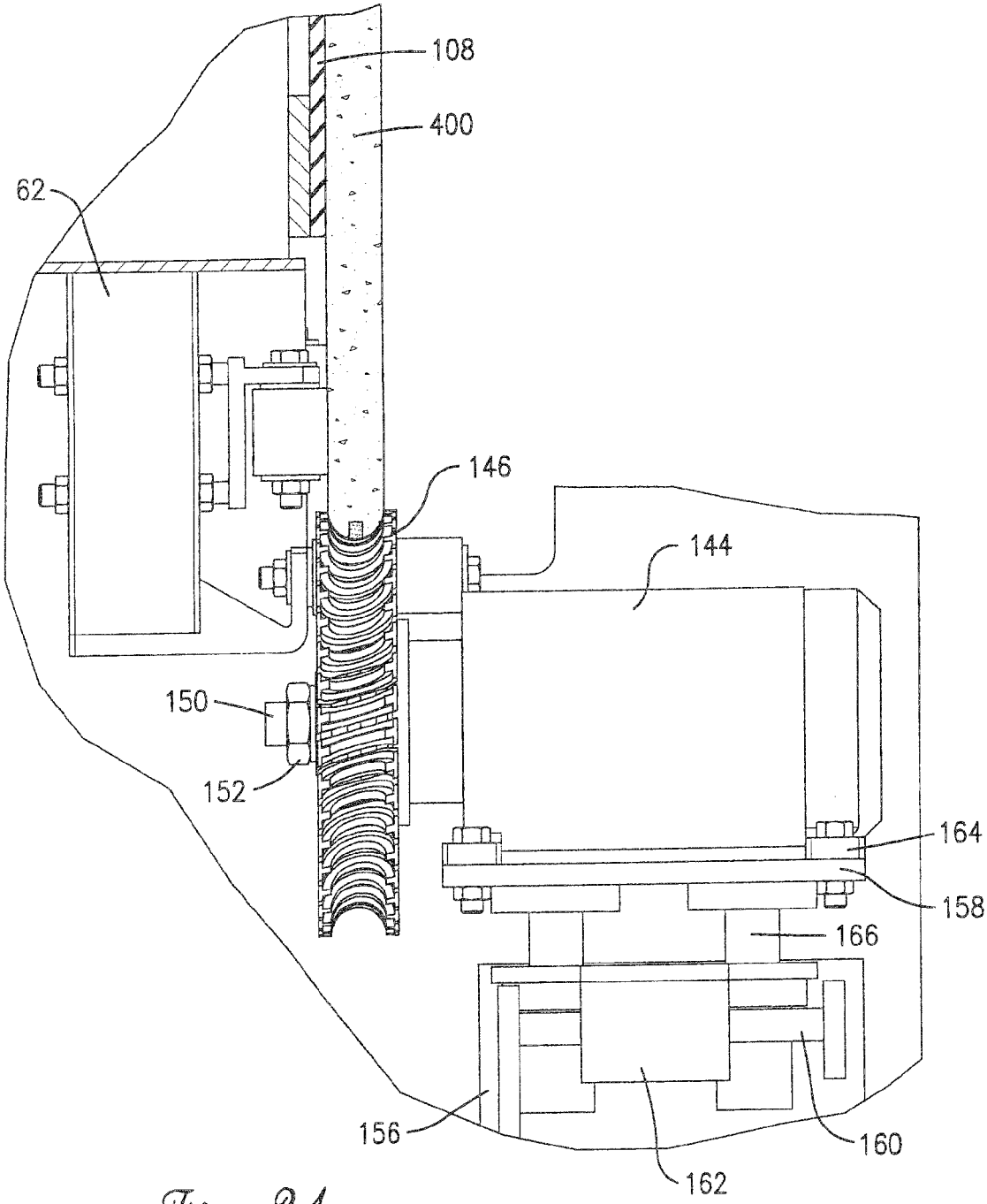
FIG. 21 is an enlarged fragmentary end elevational view of the stone machining tool shown in FIGS. 19 and 20.
Figure 22:
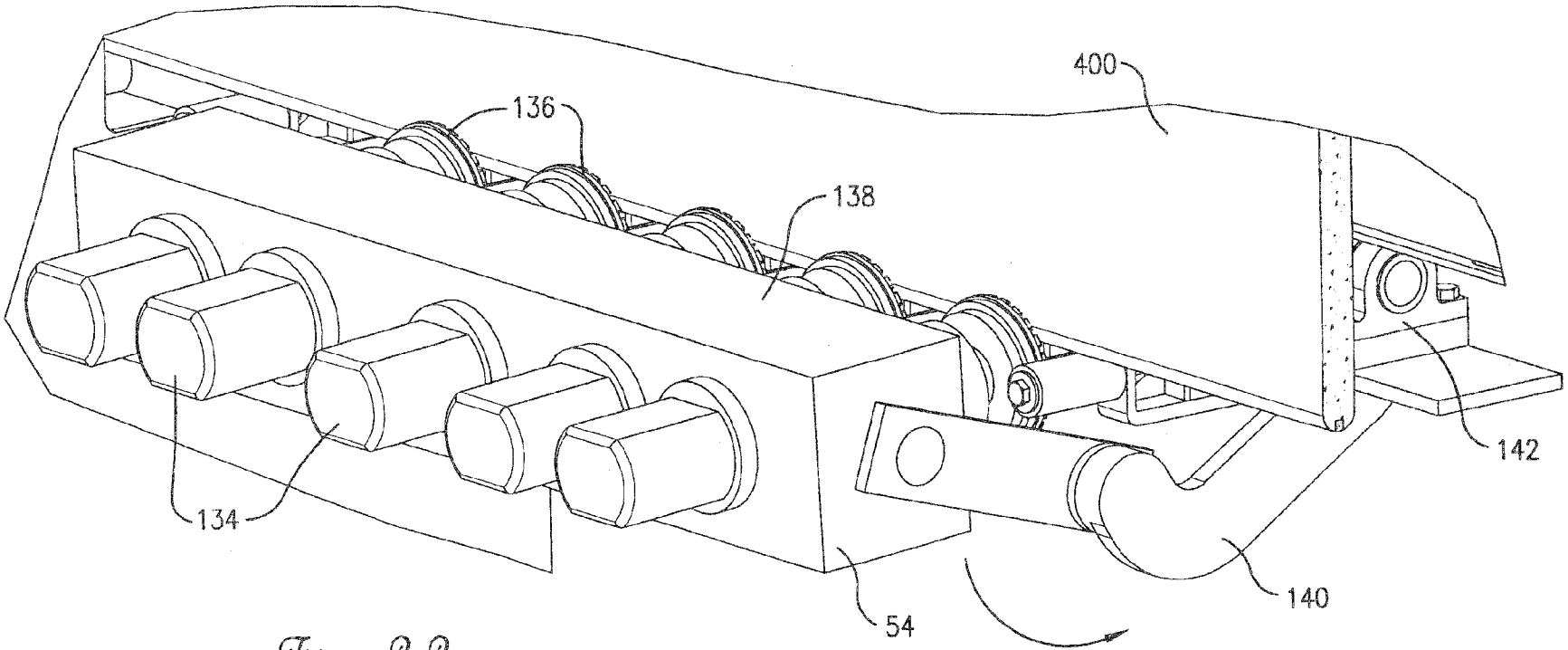
FIG. 22 is an enlarged fragmentary perspective view of the stone machining tool shown in FIGS. 1-6, showing the polishing assembly polishing the bull nose profile of the stone.
Figure 23:
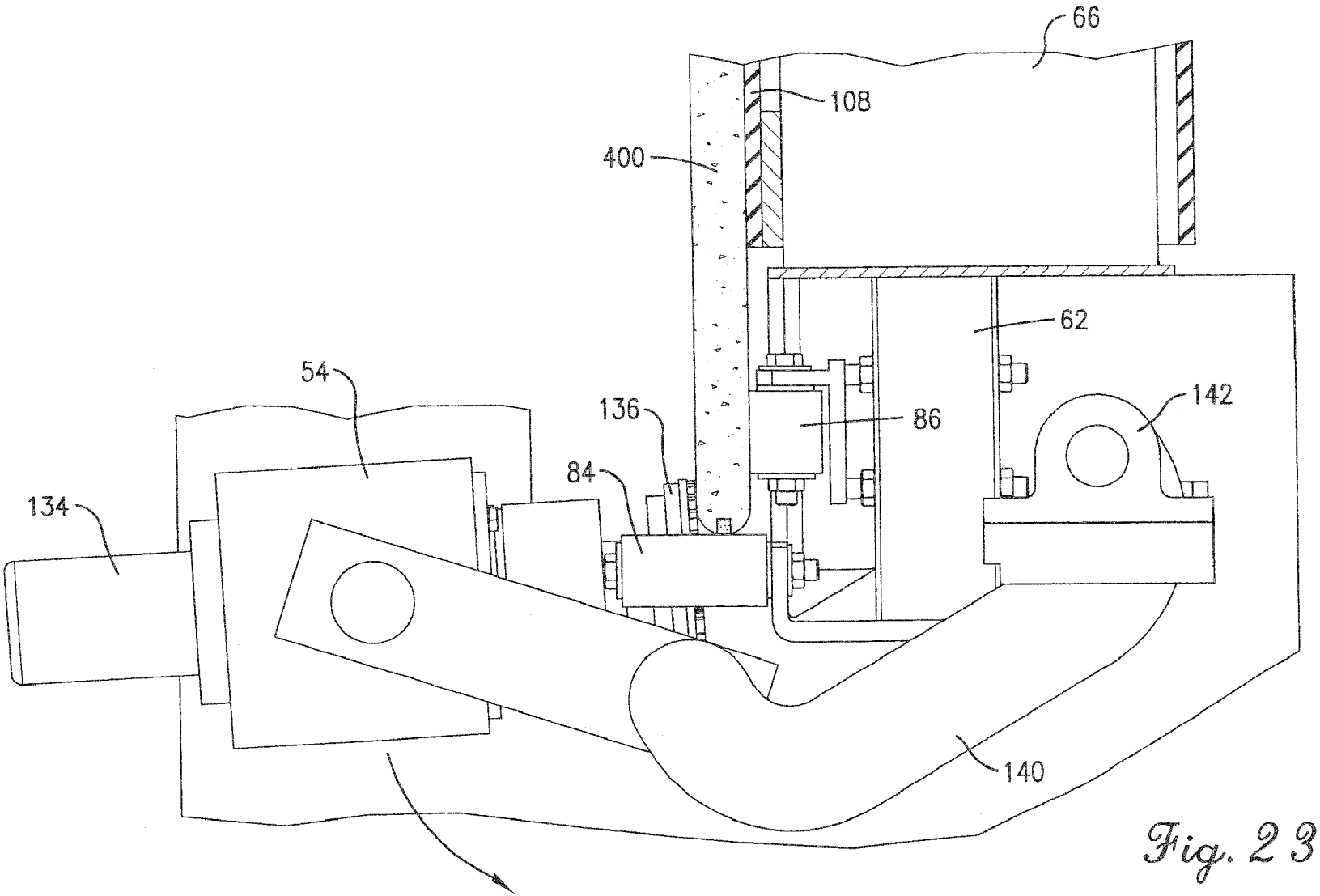
FIG. 23 is an enlarged fragmentary end elevational view of the stone machining tool shown in FIG. 22.

Turning to FIGS. 19-21, the shaping assembly 56 is positioned within bay 78 and includes a motor 144 and a shaping wheel 146 drivingly attached to the motor 144. The motor 144 includes a motor body 148, a rotatable mandrel 150, and a nut 152. The shaping wheel 146 is secured onto the mandrel 150 by the nut 152. The motor 144 is attached to the frame 62 by a bracket assembly 154. The bracket assembly 154 includes a fixed bracket 156 that is attached to the frame 62, a shiftable bracket 158 that is connected to the fixed bracket 156 by a pair of rods 160 and linear bearings 162, and a flange 164 that is connected to the shiftable bracket 158 by upright posts 166. The flange 164 is secured to the motor body 148 by fasteners.

The shaping wheel 146 is shiftable laterally and vertically relative to the upright datum plane. In particular, the linear bearings 162 permit lateral movement into and out of the trough 74 in a direction normal to the upright datum plane. The illustrated bracket assembly 154 also permits vertical movement of the shaping wheel 146 into and out of the trough 74. The shaping wheel 146 is preferably positioned so that the rotational axis of the mandrel 150 is perpendicular to the upright datum plane. The motor 144 preferably rotates at about 1400 rpm, but could rotate faster or slower without departing from the scope of the present invention. The illustrated shaping wheel 146 is a segmented bull nose wheel. But the principles of the present invention are applicable where other types of wheels are used for shaping the stone 42, as will be discussed. Additional preferred details of the illustrated machining tool 40 are disclosed in a manual entitled INSTRUCTION BOOKLET, prepared by Marmo Meccanica SPA, dated January 2007; in a manual entitled CATOLOGO RICAMBI, prepared by Marmo Meccanica SPA, dated November 1998; and in a marketing brochure entitled LCT-EDGE POLISHING MACHINE, prepared by Marmo Meccanica SPA, all of which are hereby incorporated by reference in their entirety herein.

Turning to FIGS. 9-12, 33, and 34, a groove-cutting blade assembly 168 is operable to be installed on the mandrel 150 for cutting the groove 48. The illustrated blade assembly 168 includes three (3) blades 170 arranged side-by-side and secured onto the mandrel 150 with opposite plates 172, bushing 174, and washer 176. Each blade 170 is preferably a segmented ten (10) inch diameter diamond-tipped saw blade. More preferably, the illustrated blade 170 is designated Segmented Blade for Granite, Stock No. 118494, manufactured by Diarex® and supplied by GranQuartz of Tucker, Ga. The blade 170 is unitary and includes a blade body, with an outermost arcuate blade perimeter 178, and a diamond layer 180 extending along the perimeter 178. The blade 170 presents uniformly spaced apart notches 182 and further includes blade edge segments 184 spaced between respective pairs of adjacent notches 182. The blade 170 presents a blade width 186 along the perimeter 178, the notches 182 each present a notch length 188, and the segments 184 each present a segment length 190. Preferably, the segment length 190 is longer than the notch length 188. Also, the blades 170 cooperatively define a blade assembly width 192. Preferably, the blade assembly width 192 is longer than the notch length 188. Each of the blades 170 are preferably formed with an arbor hole with a diameter of about 50 millimeters, with the arbor hole receiving the bushing 174. The bushing 174 preferably includes an outermost diameter of about 50 millimeters and an innermost diameter of about 35 millimeters, but the bushing 174 could be alternatively sized. The bushing 174 is preferably made of brass, but could be made of other materials. The bushing 174 is snugly received within each of the blades 170 when the blade assembly 168 is installed.

Figure 25:
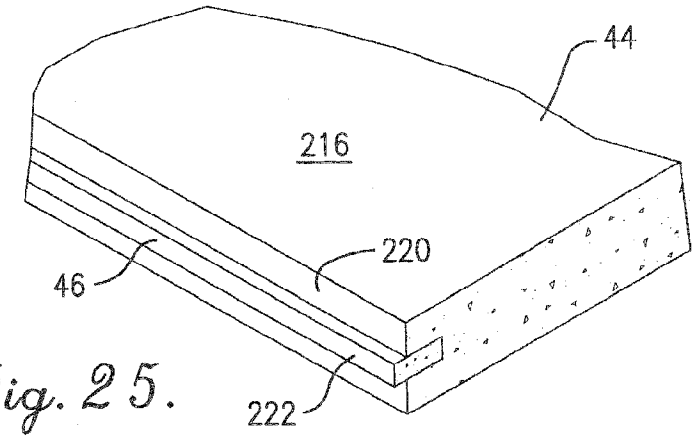
FIG. 25 is a fragmentary perspective view of the inlaid stone composite shown in FIG. 24, showing the stone inlay adhered within the groove, prior to an excess portion of the inlay being removed.
Figure 24:
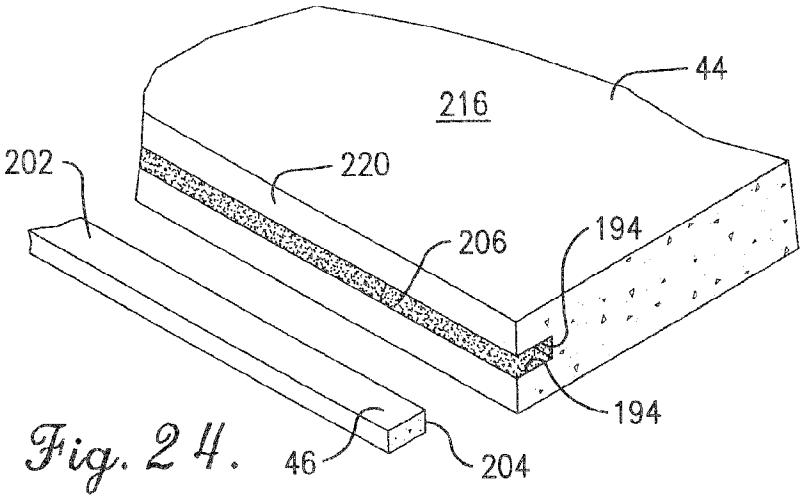
FIG. 24 is a fragmentary perspective view of an inlaid stone composite constructed in accordance with a second embodiment of the present invention, with the inlaid stone composite including a stone body, a stone inlay, and adhesive, and showing the inlaid stone composite prior to the stone inlay being adhered within a groove of the stone body.

Turning to FIGS. 24-26, the stone panel 42 includes the body stone 44 and inlay stone 46 as described above. The groove 48 preferably presents opposite interior side surfaces 194 and an interior bottom surface 196 to form a substantially rectangular groove profile, with the body stone 44 also presenting a finished exterior top surface 198. The groove 48 also presents a width defined as the distance from one interior side surface 194 to the other, and a depth defined along one of the side surfaces 194 from the interior bottom surface 196 to the exterior top surface 198. But the principles of the present invention are equally applicable where the groove 48 presents the side surfaces 194 while having an alternative profile shape, e.g. a trapezoid shape or a rectangular shape with a rounded bottom surface. While each of the illustrated side surfaces 194 are preferably substantially flat, it is also within the scope of the present invention for the side surfaces 194 to be arcuate or to have another non-flat shape. Furthermore, the groove profile preferably remains substantially constant along an edge axis of the stone panel 42.

The inlay stone 46 presents a substantially rectangular profile, with the inlay stone 46 including a finished exterior top inlay surface 200, opposite interior side surfaces 202, and an interior bottom surface 204 to form the substantially rectangular inlay profile. The inlay stone 46 also presents a width defined as the distance from one interior side surface 202 to the other, and a depth defined along one of the side surfaces 202 from the interior bottom surface 204 to the exterior top inlay surface 202. However, the principles of the present invention are equally applicable where the inlay stone 46 presents the side surfaces 202 while having an alternative profile shape, e.g. a trapezoid shape or a rectangular shape with a rounded bottom surface. While each of the illustrated side surfaces 202 are preferably substantially flat, it is also within the scope of the present invention for the side surfaces 202 to be arcuate or to have another non-flat shape. Furthermore, the inlay profile preferably remains substantially constant along an inlay axis of the inlay stone 46. The illustrated inlay stone 46 includes a very thin width that is preferably about one-quarter of an inch, but the principles of the present invention are applicable where the inlay width is thinner or thicker.

With the stones 44,46 being assembled and finished to provide the stone panel 42, the inlay stone 46 is inserted within the groove 48, with the body stone 44 and inlay stone 46 cooperatively forming an inlaid margin of the stone panel 42. Furthermore, the exterior surfaces 198,200 cooperatively present a finished layered edge surface with a flat polish profile. As will be described in subsequent embodiments, it is entirely within the scope of the present invention where the stone panel 42 has an alternative profile that presents one or more shapes. For instance, the profile may include traditional architectural shapes such as cavetto, ovolo, cyma, ogee, or combinations thereof.

Preferably, the inlay stone 46 exhibits a frictional fit within the body stone 44, i.e., abutting, frictional engagement occurs between the mating pairs of side surfaces 194,202 as the inlay stone 46 is fully inserted into the groove 48, with the inlay stone 46 and groove 48 having substantially complementally shaped profiles. Preferably, the inlay width and the corresponding width of the groove 48 are both machined to their final dimensions, with a tolerance preferably of less than about 0.010 inches. Furthermore, each of the mating pairs of side surfaces 194,202 preferably present a gap that is less than about 0.050 inches thick. It has been observed that the close tolerances of inlay width and groove width discussed above permit the stones 44,46 to be made so that this frictional fit is possible. Unexpectedly, it has also been observed that such a close fit limits chipping of the stones 44,46 as the finished layered edge surface is formed. In particular, the relatively thin inlay stone 46, like other thin stone layers or veneers, is often subject to substantial chipping when machined. But the illustrated combination of stones 44,46 has been found to unexpectedly reduce the instances of chipping.

It has also been determined that surface roughness also contributes to the desired fit between the stones 44,46. Preferably, the interior side surfaces 194,202 also include an RMS average surface roughness of 32 microinches or rougher. However, the principles of the present invention are applicable where side surfaces 194,202 present an RMS average surface roughness that is smoother than 32 microinches. Preferably, the inlay stone 46 of the finished panel is finished so that the depth is longer than the width to provide the desired frictional fit. However, the depth could be shorter than the width without departing from the scope of the present invention.

An adhesive 206 resides between the stones 44,46 and interconnects side surfaces 194,202 and bottom surfaces 196, 204 (see FIG. 24). Preferably, the adhesive 206 is an epoxy adhesive that is suitable for bonding stone surfaces to one another and that cures quickly. More preferably, the adhesive 206 includes a two-part, polyester-based epoxy designated "Marble Filler 1000," which is manufactured by AKEMI GmbH of Nurembourg, Germany. However, it is within the scope of the present invention to use other adhesives, e.g., a UV curable adhesive or a heat-activated adhesive. The illustrated adhesive 206 also preferably includes a colored paste for giving the adhesive 206 a predetermined color.

While the illustrated panel 42 preferably only includes the inlay stone 46 and adhesive 206 positioned within the groove 48, the principles of the present invention are applicable where other materials are secured in the groove 48. Also, the finished layered edge surface preferably presents a flat polish profile with the profile extending along a substantially straight edge of the edge surface. However, the principles of the present invention are applicable where the profile extends along a non-linear edge, e.g., the arcuate edge of an oval shaped tabletop.

Turning again to FIGS. 1 and 2, the stone panel 42 is manufactured by initially machining the body stone 44 and the inlay stone 46. The body stone 44 and inlay stone 46 are normally cut from slabs or panels, whether the material is natural or man-made, using a bridge saw 208 (see FIG. 13). However, it is also within the ambit of the present invention for the stones 44,46 to be formed using other devices. For instance, another preferred device to trim the inlay stone 46 to the desired thickness, i.e., the distance from one side surface 202 to the other, is a drum grinder. The illustrated bridge saw 208 is conventional and includes a powered saw 210 slidably mounted on a beam 212 for making substantially straight cuts.

Figure 9:
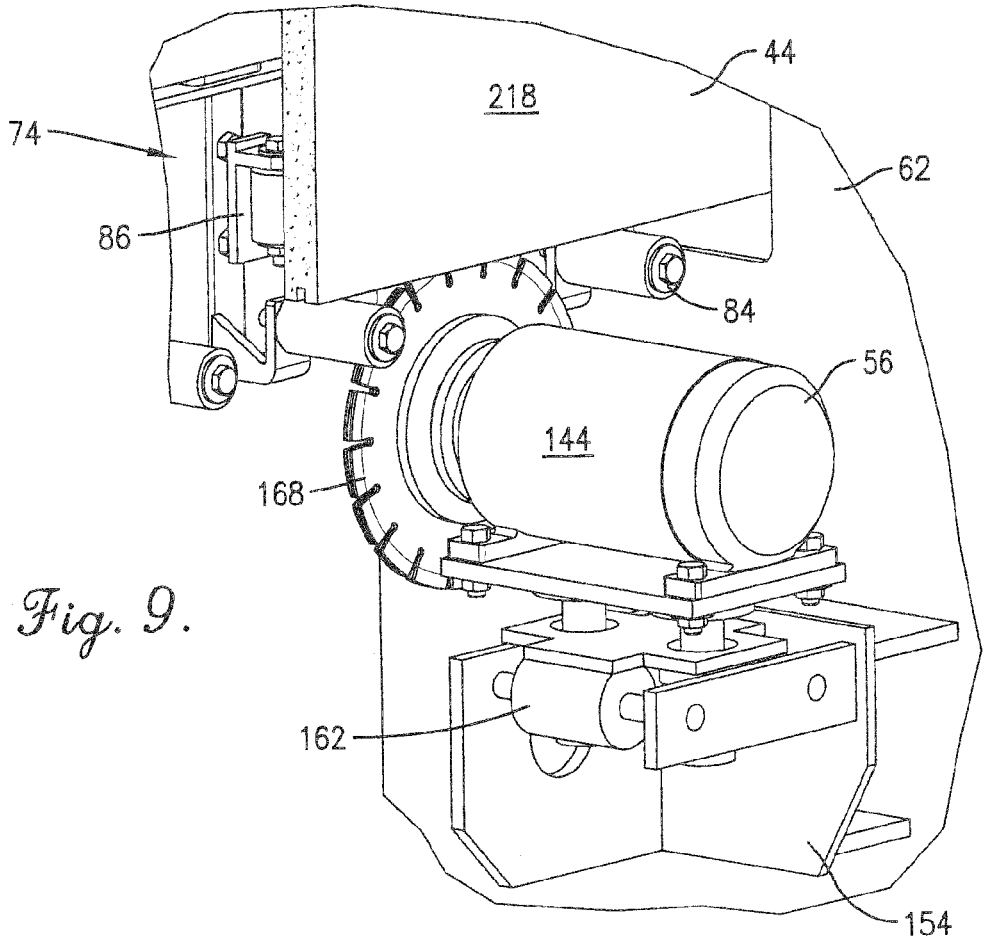
FIG. 9 is an enlarged fragmentary front perspective view of the stone machining tool shown in FIGS. 1-6, showing the shaping assembly with a blade assembly mounted thereon, with the shaping assembly machining a groove in a stone body.
Figure 10:
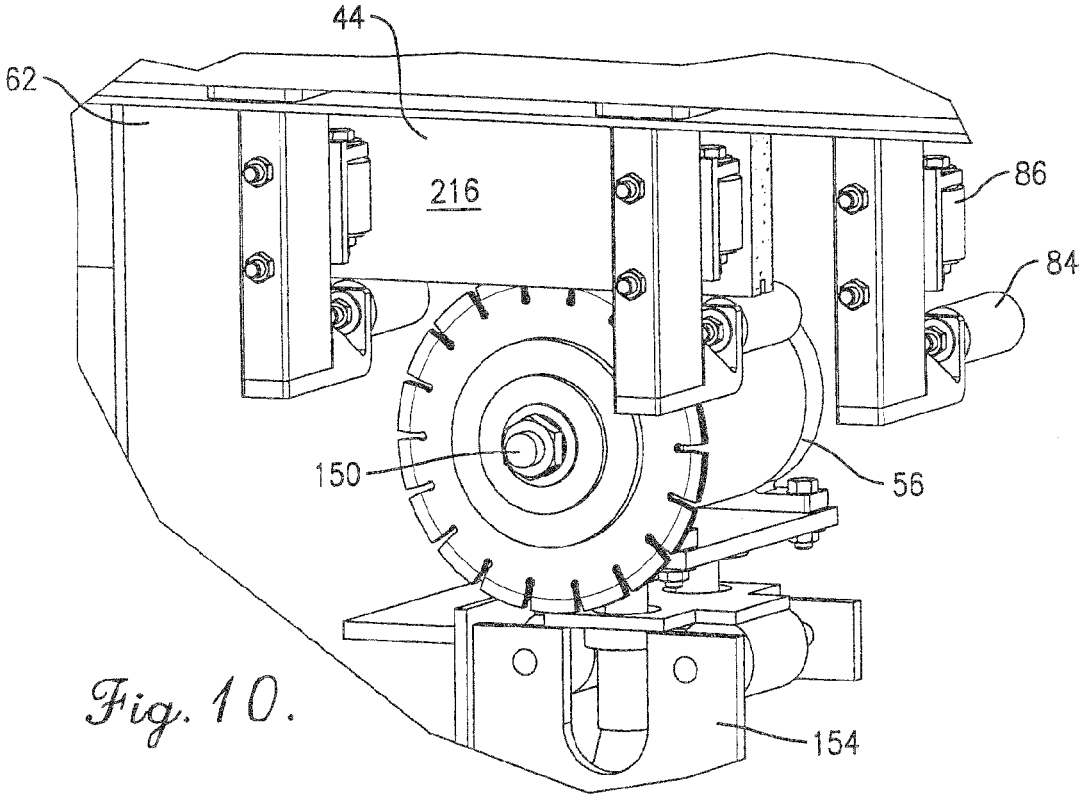
FIG. 10 is an enlarged fragmentary rear perspective view of the stone machining tool shown in FIGS. 1-6 and 9, showing the shaping assembly machining the groove.
Figure 11:
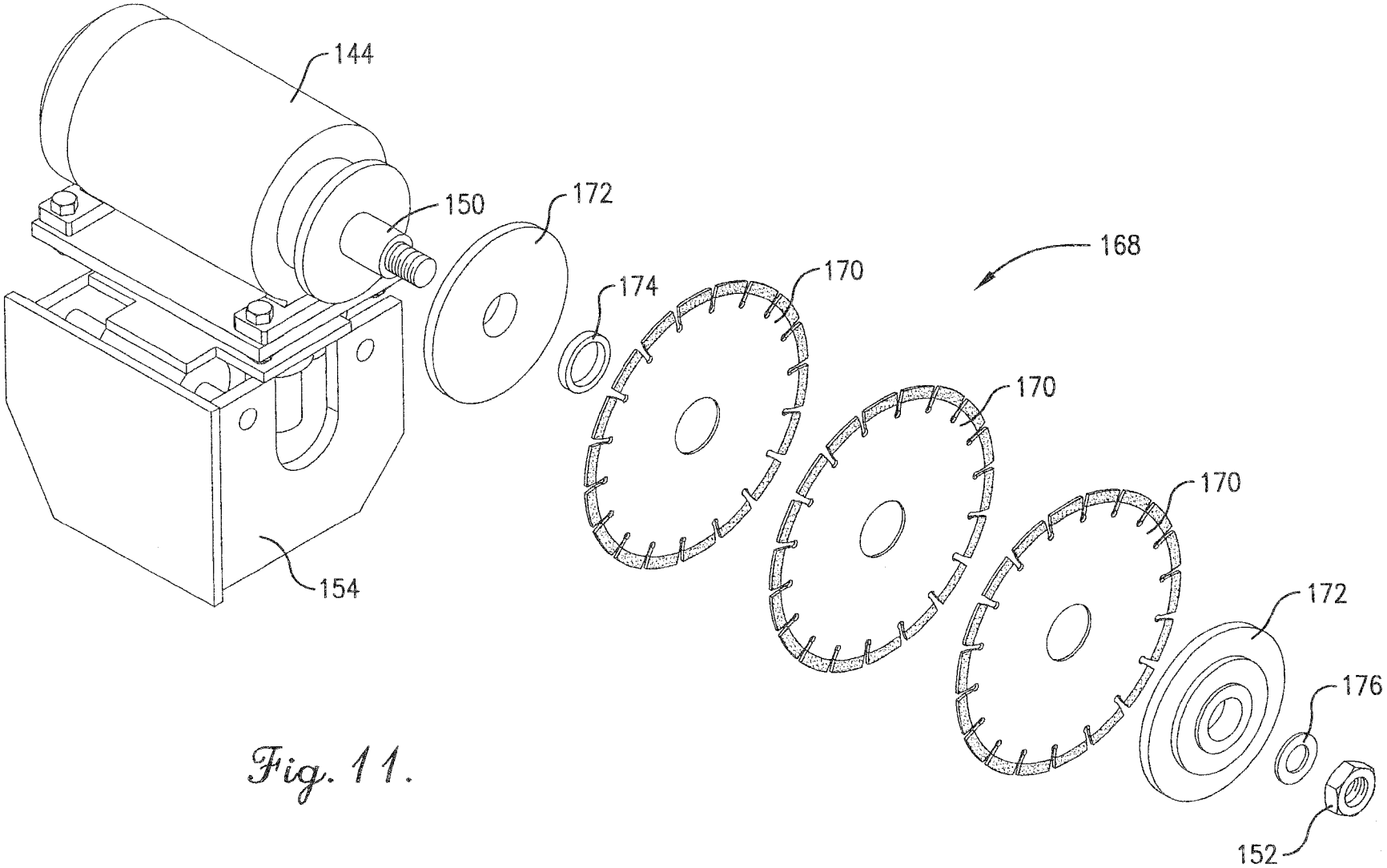
FIG. 11 is an exploded view of the shaping assembly shown in FIGS. 9 and 10.
Figure 12:
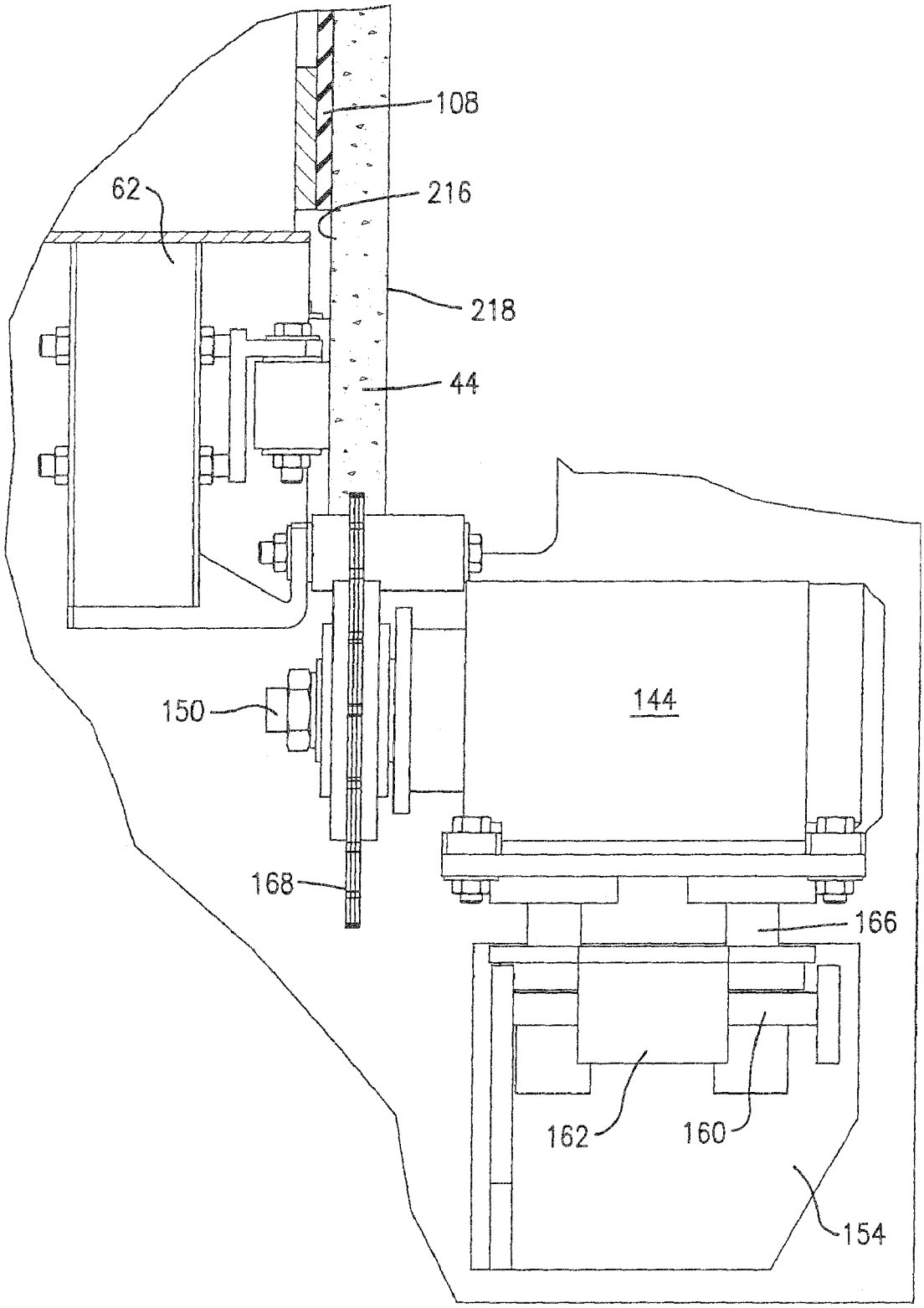
FIG. 12 is an enlarged fragmentary end elevational view of the stone machining tool shown in FIGS. 1-6, 9, and 10, showing the shaping assembly as it machines the groove.

Turning to FIGS. 9 and 10, the body stone 44 is then further machined to form the groove 48. One of a pair of roller tables 214 serve to support the body stone 44 as it enters the machining tool 40 (see FIG. 2). The stone panel 42 presents opposite finished and unfinished sides 216,218, where the finished side 216 is substantially planar. However, the principles of the present invention are applicable where both sides 216,218 are finished or unfinished. As the body stone 44 is fed into the machining tool 40, the finished side 216 is positioned in contact with the endless belt 108 so that the belt 108 grabs the finished side 216 and pulls the body stone 44 through the trough 74 from the entry end 112 to the exit end 114 (see FIG. 12). As the body stone 44 is fed through the trough 74, roller assemblies 84 and 86 provide vertical and lateral support, respectively. The shiftable roller assemblies 92 also urge the stone panel 42 into engagement with the endless belt 108.

Figure 7:
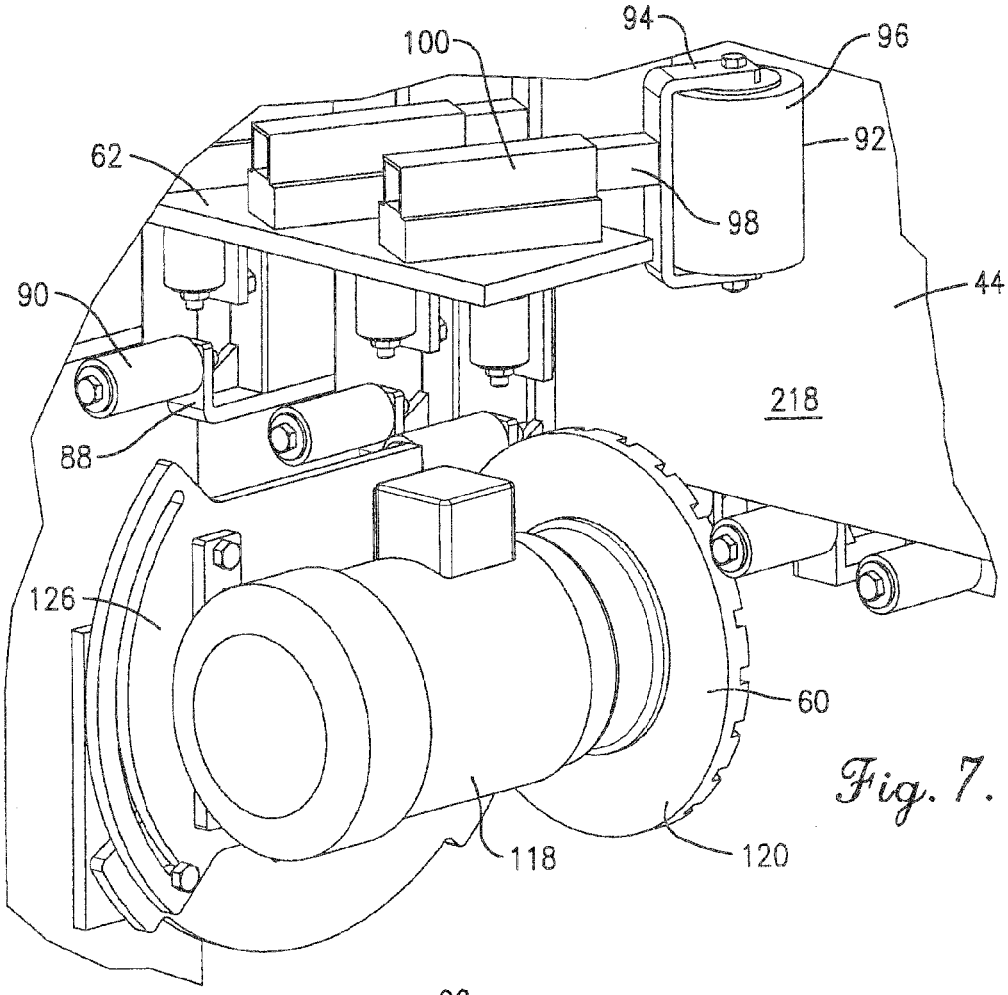
FIG. 7 is an enlarged fragmentary front perspective view of the stone machining tool shown in FIGS. 1-6, showing the calibrating assembly.
Figure 8:
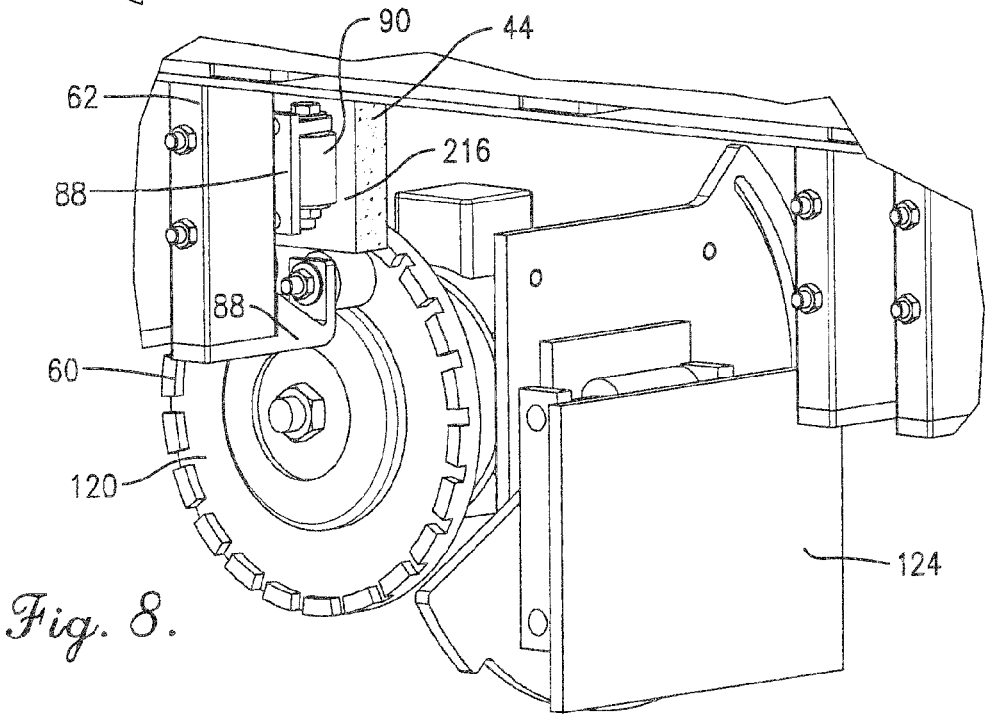
FIG. 8 is an enlarged fragmentary rear perspective view of the stone machining tool shown in FIGS. 1-6, showing the calibrating assembly.

Turning to FIGS. 7 and 8, the calibrating assembly 60 is preferably operated to remove some material from the unfinished side 218. In this manner, any variations in thickness of the body stone 44 adjacent the panel edge can be removed by machining away a thin layer of material. But the principles of the present invention are also applicable where the calibrating assembly 60 is not used to machine the body stone 44, e.g., where any thickness variations are negligible.

Turning again to FIGS. 9-12, the groove 48 is machined into the body stone 44 by first installing the blade assembly 168 onto the mandrel 150 and then by turning on the shaping assembly 56 and simultaneously feeding the body stone 44 through the trough 74. The illustrated blade assembly 168 is operable to cut the rectangular groove profile along an unfinished exterior edge surface 220, with the groove 48 substantially bisecting the edge surface 220 (see FIG. 24). While the groove 48 is preferably cut in a single cutting pass with the machine 40, the groove 48 could be cut in multiple cutting passes without departing from the scope of the present invention. Furthermore, the blade assembly 168 could be configured to cut an alternatively shaped groove or more than one groove.

The inlay stone 46 presents the side surfaces 194, the bottom surface 196, and, initially, the unfinished exterior edge surface 220. Prior to assembling the stones 44,46, water and other impurities are removed from the unfinished exterior edge surface 220 and from within the groove 48. To assemble the stones 44,46, the adhesive 206 is applied to the interior surfaces 194,196 (see FIG. 24). With the inlay stone 46 fully received within the groove 48, the bottom surfaces 196,204 are preferably positioned adjacent to one another, with adhesive 206 being received therebetween (see FIG. 25). Adhesive 206 is also received between each pair of mating side surfaces 194,202. Before any machining of the adhered stones 44,46, the depth of the inlay stone 46 is greater than the groove depth so that an excess part 222 of the inlay stone 46 projects outwardly from the unfinished exterior edge surface 192. In this manner, the disclosed structure and method does not require precise matching of inlay depth and groove depth prior to assembly of the stones 44,46, although the depths could be substantially matched with one another so that substantially no excess part 222 is formed.

Figure 13:
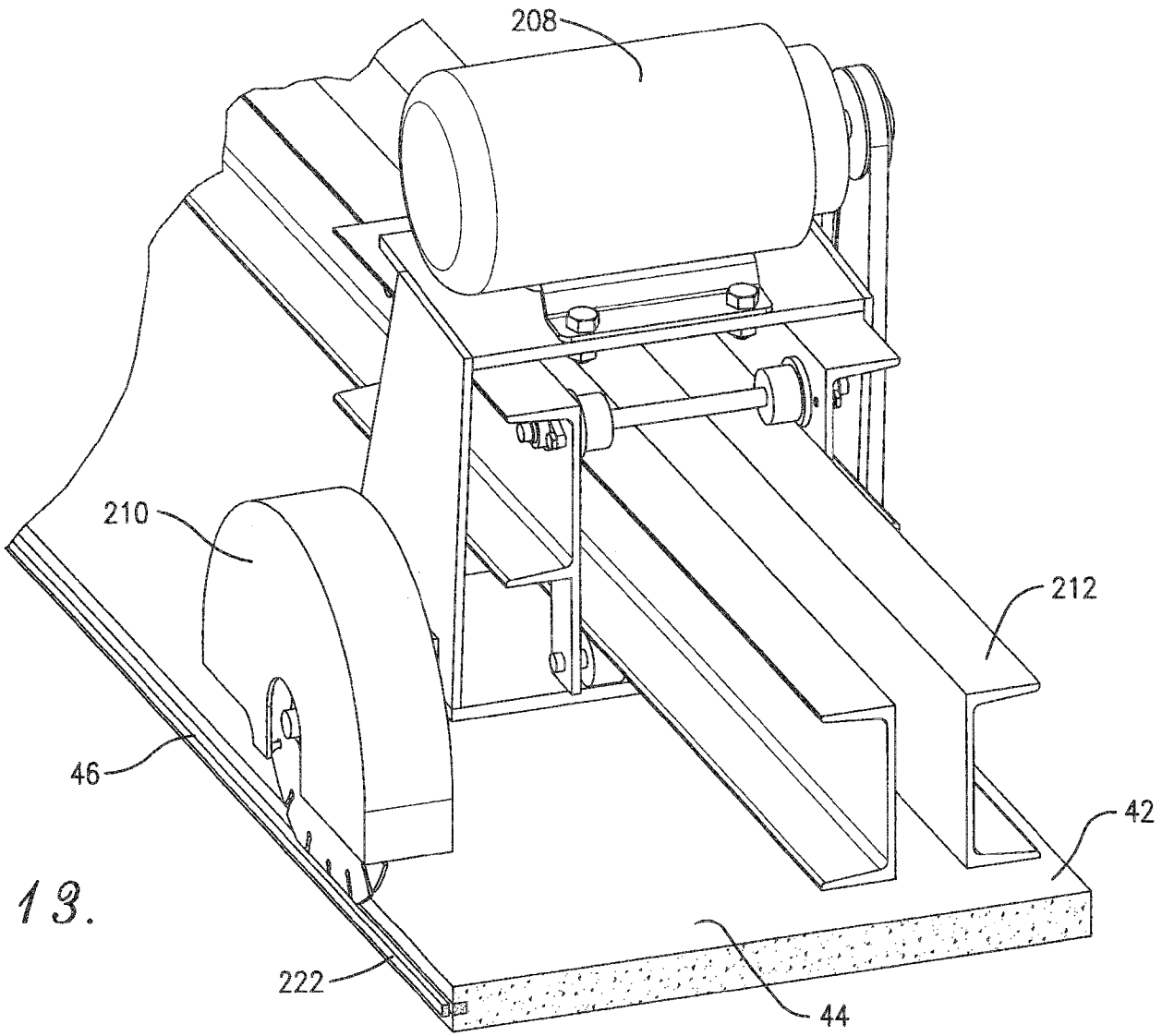
FIG. 13 is a fragmentary perspective view of the stone shown in FIG. 12, showing a stone inlay secured within the stone to form an inlaid stone composite, with an excess portion of the inlay being cut away by a bridge saw.

Turning to FIG. 13, the combined stones 44,46 are positioned on the bridge saw 208 so that the excess part 222 can be cut from the inlaid margin of the stones 44,46. Although part of only the inlay stone 46 is removed in the illustrated embodiment, it is within the scope of the present invention to remove part of both stones 44,46 from the inlaid margin in order to leave a substantially flat edge surface of the panel 42. It has been determined that removal of the excess part 222 unexpectedly serves to limit any chipping of the stones 44,46 during subsequent shaping or polishing operations as will be discussed below. In particular, it has been found that instances of chipping of the stone panel 42 are reduced by removing any excess part 222 prior to subsequent machining. Such chipping is difficult to avoid, particularly with natural stones, but the disclosed method results in lower than normal incidences of chipping. While the bridge saw 208 is preferred for removing the excess part 222, the principles of the present invention are applicable where another machine, such as a drum grinder, is used to remove the excess part 222.

Figure 14:
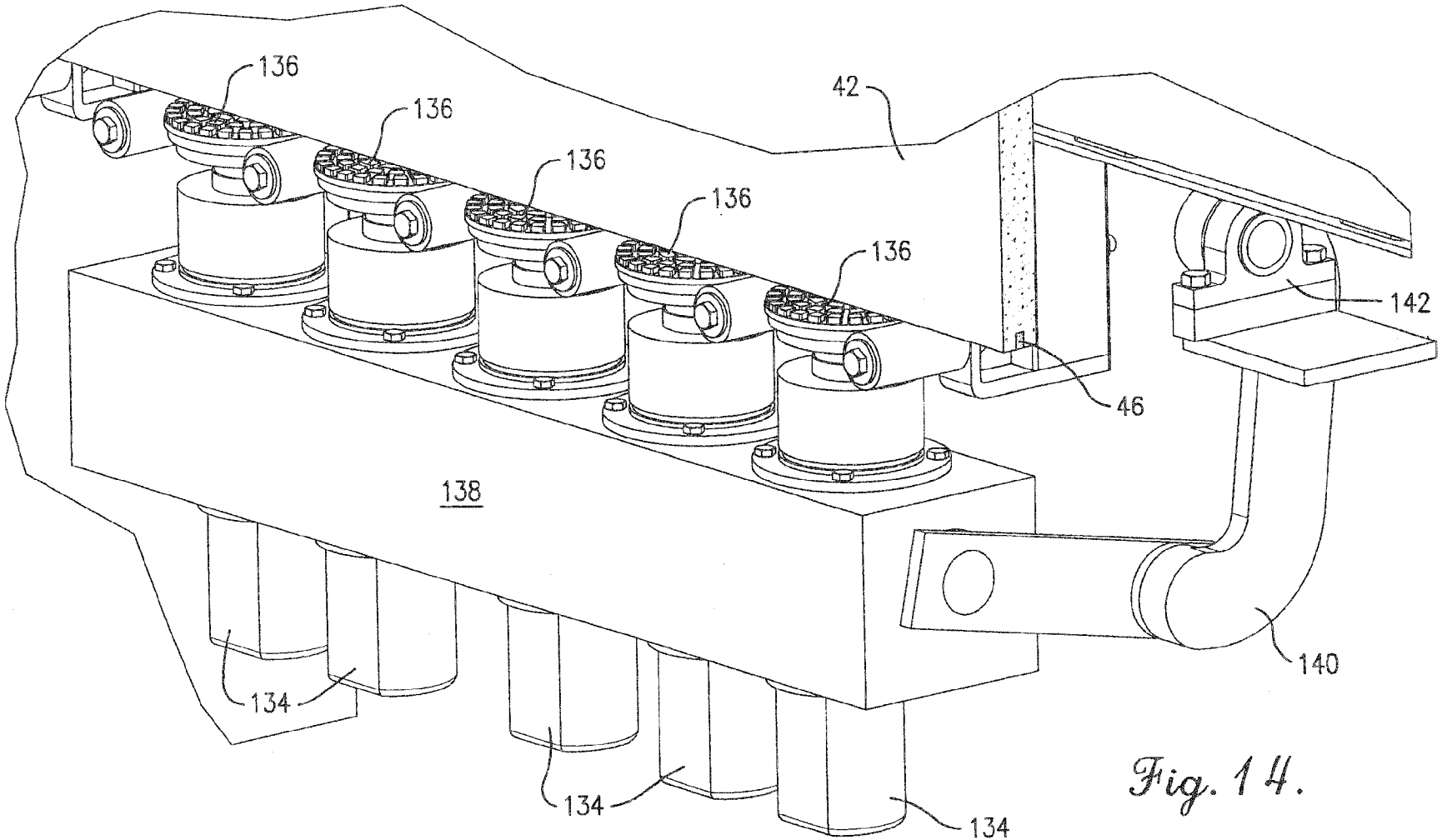
FIG. 14 is an enlarged fragmentary front perspective view of the stone machining tool shown in FIGS. 1-6, showing the inlaid stone composite being polished by the polishing assembly to form a flat polish profile.
Figure 15:
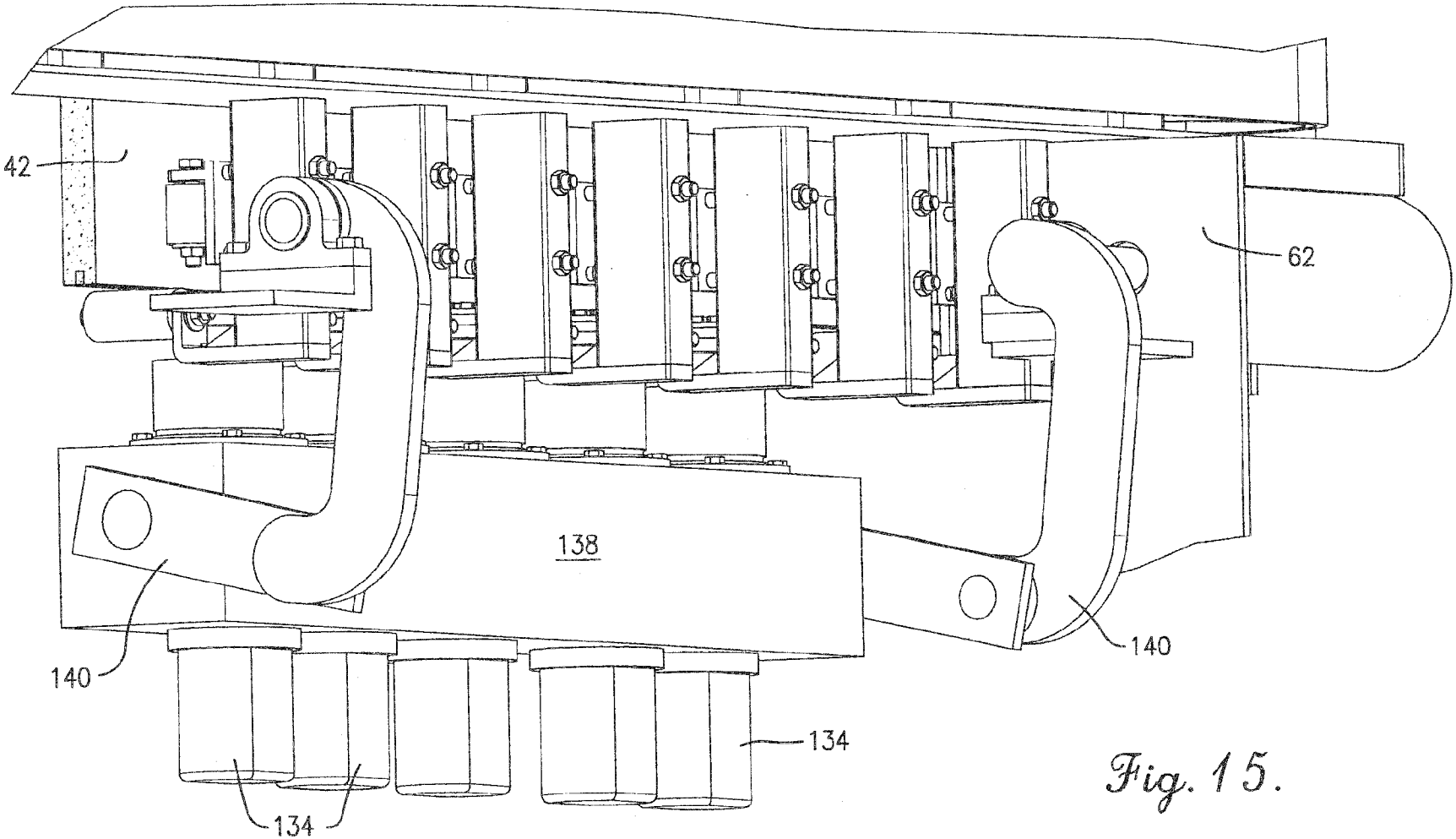
FIG. 15 is an enlarged fragmentary rear perspective view of the stone machining tool shown in FIG. 14.
Figure 16:
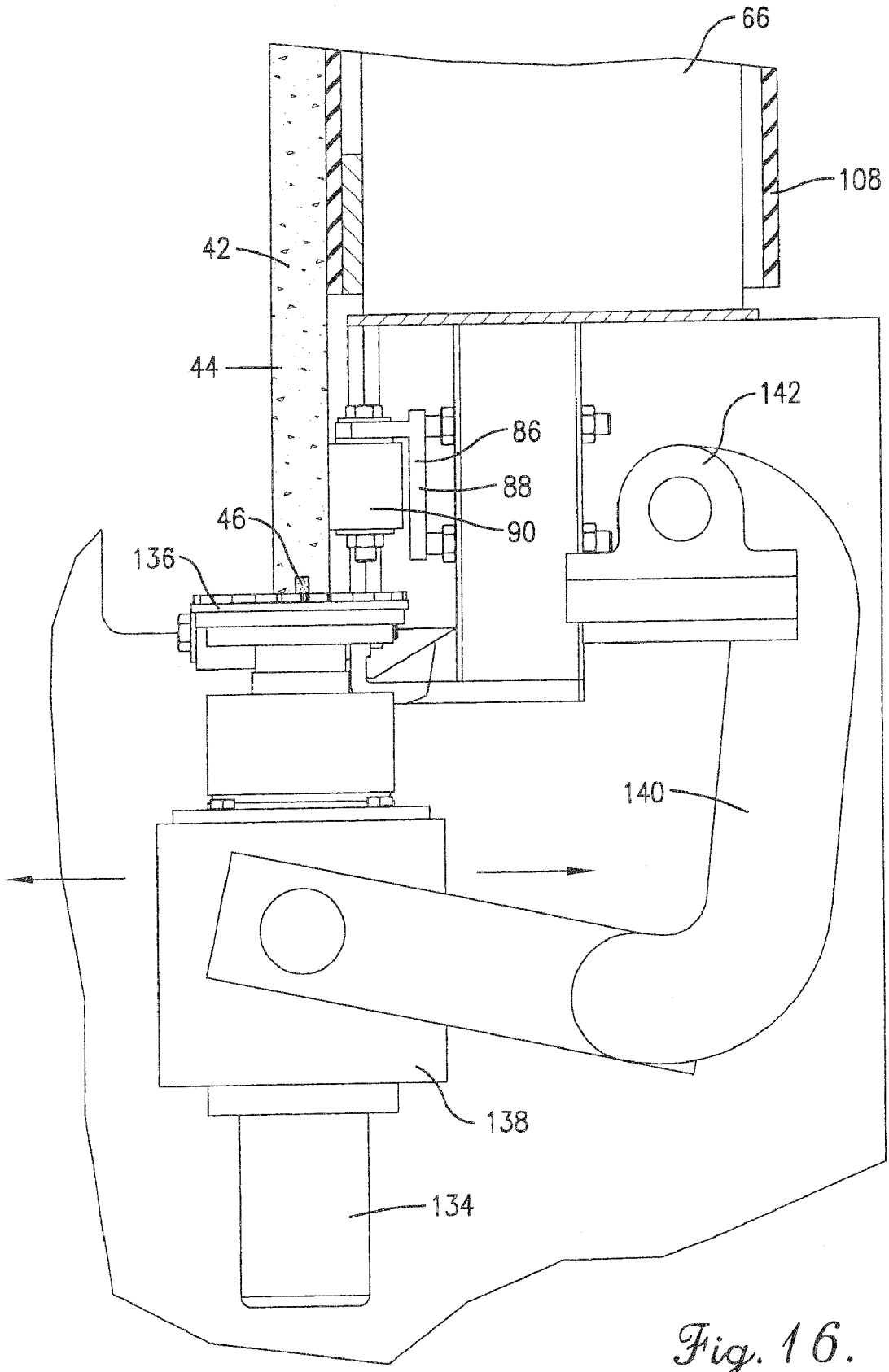
FIG. 16 is an enlarged fragmentary end elevational view of the stone machining tool shown in FIGS. 14 and 15.

Turning to FIGS. 14-16, the stones 44,46 are polished by the polishing assembly 54 to provide the finished layered edge surface of the stone panel 42. Preferably, the polishing assembly 54 operates to pivot the block 138 slightly through an oscillating pivotal movement as the wheels 136 rotate and the stone panel 42 is fed through the machine 40. It has been determined that such oscillation results in a desirable polished finish.

Turning to FIGS. 27-36, alternative preferred embodiments of the present invention are depicted. For the purpose of brevity, the remaining description will focus primarily on the differences of these alternative embodiments from the preferred embodiment described above.

Figure 27:
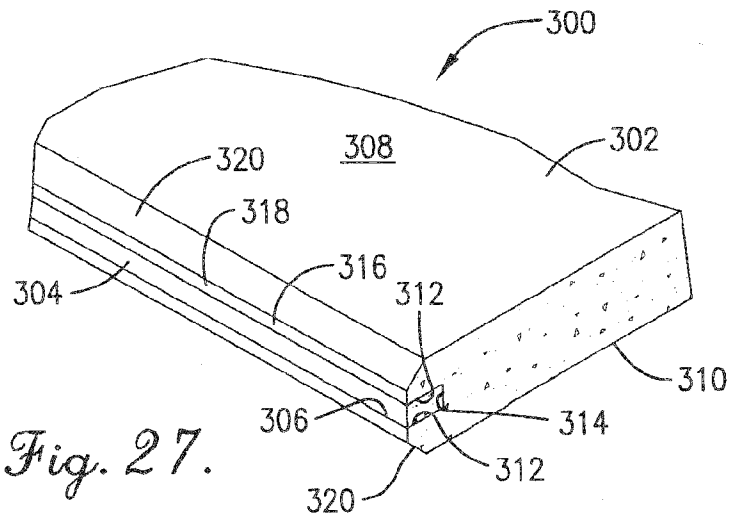
FIG. 27 is a fragmentary perspective view of an inlaid stone composite constructed in accordance with a third embodiment of the present invention, with the inlaid stone composite having a chamfered profile.

Turning to FIG. 27, an alternative stone panel 300 is constructed in accordance with a second preferred embodiment of the present invention. The alternative stone panel 300 presents a chamfered edge profile and includes a body stone 302 and an inlay stone 304. The body stone 302 includes a groove 306 and presents finished and unfinished sides 308, 310. The groove 306 preferably presents opposite interior side surfaces 312 and an interior bottom surface 314 to form a substantially rectangular groove profile, with the body stone 302 also presenting a finished exterior top surface 316. The finished exterior top surface 316 includes a flat portion 318 that is about perpendicular to the sides 308,310 and chamfered portions 320 that are spaced between the flat portion 318 and respective ones of the sides 308,310. Each of the chamfered portions 320 are angled relative to the flat portion 318 to form an exterior angle therebetween, i.e., an angle formed exteriorly between two adjacent sides, of about 225 degrees. However, it is within the ambit of the present invention where the chamfered portions 320 are oriented at a different angle relative to the flat portion 318.

The stone panel 300 is machined using manufacturing steps similar to those depicted for the stone panel 42. Once the inlay stone 304 is adhered within the groove 306 and an excess portion (not shown) of the inlay stone 304 is removed, the stone panel 300 is machined to produce the chamfered surface portions 320. In particular, the chamfering assembly 58 is configured to chamfer the stone panel 300 (see FIGS. 17 and 18). The stone panel 300 is then polished with the polishing assembly 54 to provide a finished layered edge surface.

Figure 28:
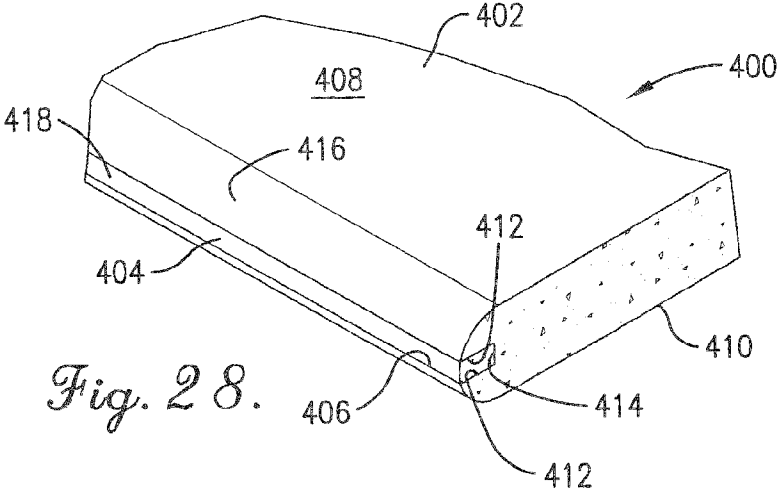
FIG. 28 is a fragmentary perspective view of an inlaid stone composite constructed in accordance with a third embodiment of the present invention, with the inlaid stone composite having a bull nose profile.

Turning to FIG. 28, an alternative stone panel 400 is constructed in accordance with a third preferred embodiment of the present invention. The alternative stone panel 400 presents a bull nose edge profile and includes a body stone 402 and an inlay stone 404. The body stone 402 includes a groove 406 and presents finished and unfinished sides 408,410. The groove 406 preferably presents opposite interior side surfaces 412 and an interior bottom surface 414 to form a substantially rectangular groove profile, with the body stone 402 also presenting a finished exterior top surface 416. The inlay stone 404 also presents a finished exterior top inlay surface 418. The surfaces 416,418 are machined to cooperatively present a finished layered edge surface with the bull nose profile.

The stone panel 400 is machined using manufacturing steps similar to those depicted for the stone panel 42. Once the inlay stone 404 is adhered within the groove 406 and an excess portion (not shown) of the inlay stone 404 is removed, the stone panel 400 is preferably chamfered similarly to the stone panel 300. However, the principles of the present invention are applicable where the stone panel 400 is not chamfered. Then, the chamfered panel edge is machined to produce the bull nose profile. In particular, the shaping assembly 56 is configured to use the shaping wheel 146 to cut the bull nose shape along the edge of the stone panel 400 (see FIGS. 19-21). Also, a single pass of the stone panel 400 along the shaping wheel 146 is preferred for forming the bull nose shape, but additional passes along the shaping wheel 146 can be performed. The stone panel 400 is then polished with the polishing assembly 54 to provide the finished layered edge surface (see FIGS. 22 and 23).

Figure 29:
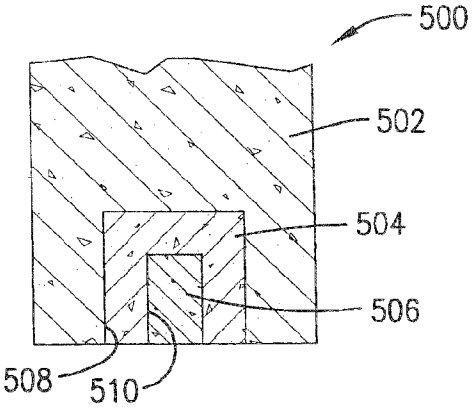
FIG. 29 is a fragmentary end view of an inlaid stone composite constructed in accordance with a fourth embodiment of the present invention, with the inlaid stone composite including a stone body, a first stone inlay adhered within a groove of the body, and a second stone inlay adhered within a groove of the first stone inlay.

Turning to FIG. 29, an alternative stone panel 500 is constructed in accordance with a fourth preferred embodiment of the present invention. The alternative stone panel 500 presents a flat polish edge profile similar to stone panel 42 and includes a body stone 502, a first inlay stone 504, and a second inlay stone 506. The body stone 502 includes a groove 508 with a substantially rectangular groove profile. The first inlay stone 504 includes an inlay groove 510. The groove 508 receives the first inlay stone 504 and the inlay groove 510 receives the second inlay stone 506, with the inlay stones 504,506 preferably extending substantially parallel to one another. In this manner, the stone panel 500 presents a finished layered edge surface that includes five layers.

Figure 30:
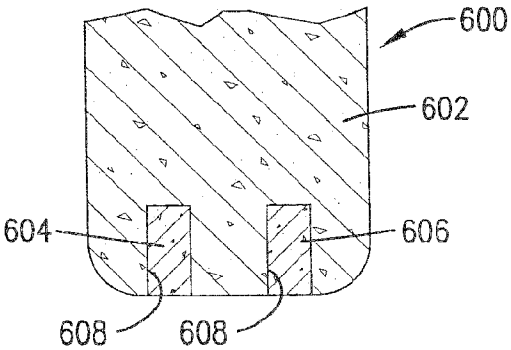
FIG. 30 is a fragmentary end view of an inlaid stone composite constructed in accordance with a fifth embodiment of the present invention, with the inlaid stone composite including a stone body, a first stone inlay adhered within a first groove of the body, and a second stone inlay adhered within a second groove of the body.

Turning to FIG. 30, an alternative stone panel 600 is constructed in accordance with a fifth preferred embodiment of the present invention. The alternative stone panel 600 presents a flat polish edge profile similar to stone panel 42, but with rounded corner edges. The stone panel 600 includes a body stone 602, a first inlay stone 604, and a second inlay stone 606, with the inlay stones 604,606 being spaced apart from one another. The body stone 602 includes a pair of grooves 608 with each having a substantially rectangular groove profile. The grooves 608 preferably extend substantially parallel to one another. Each groove 608 receives a respective one of the inlay stones 604,606. In this manner, the stone panel 600 presents a finished layered edge surface that includes five layers.

Figure 31:
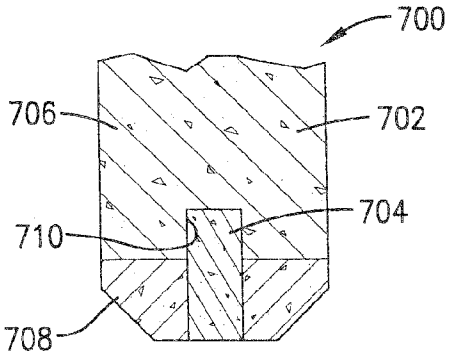
FIG. 31 is a fragmentary end view of an inlaid stone composite constructed in accordance with a sixth embodiment of the present invention, with the inlaid stone composite including a stone body with first and second body portions, and a stone inlay received within a groove of the body.

Turning to FIG. 31, an alternative stone panel 700 is constructed in accordance with a sixth preferred embodiment of the present invention. The alternative stone panel 700 presents a chamfered edge profile similar to stone panel 300. The stone panel 700 includes a body stone 702 and an inlay stone 704. The body stone 702 includes first and second body portions 706,708. The body stone 702 includes a groove 710 that extends completely through the second body portion 708 and into the first body portion 706, with the groove 710 receiving the inlay stone 704.

Figure 32:
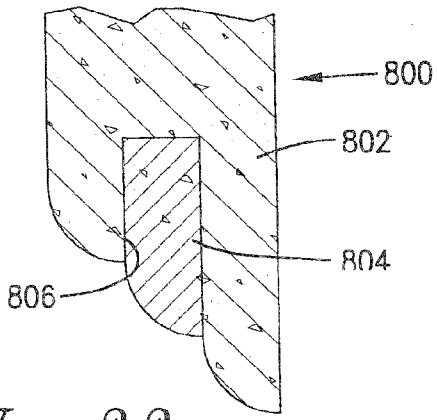
FIG. 32 is a fragmentary end view of an inlaid stone composite constructed in accordance with a seventh embodiment of the present invention, with the inlaid stone composite having a triple-pencil profile.

Turning to FIG. 32, an alternative stone panel 800 is constructed in accordance with a seventh preferred embodiment of the present invention. The alternative stone panel 800 presents a triple-pencil edge profile. The stone panel 800 includes a body stone 802 and an inlay stone 804. The body stone 802 includes a groove 806 that receives the inlay stone 804. The stones 802,804 cooperatively present a finished layered edge surface with the triple-pencil profile.

Turning to FIG. 34*a*, an alternative blade assembly 900 is constructed in accordance with an eighth preferred embodiment of the present invention. The alternative blade assembly 900 includes blades 902 that each include an outermost perimeter 904 and a central uncoated portion 906, with a diamond coating (not shown) extending along the perimeter 904. The blades 902 are constructed so that each uncoated portion 906 is in contact with respective adjacent portions 906.

Turning to FIGS. 35 and 36, an alternative blade assembly 1000 is constructed in accordance with a ninth preferred embodiment of the present invention. The alternative blade assembly 1000 includes a single blade 1002 and a bushing 1004. The single blade 1002 has an outermost perimeter 1006 and a central uncoated portion 1008 with an arbor hole 1010. The bushing is received within the hole 1010.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers; and (d) removing part of the second layer from the inlaid margin after securing the second layer within the groove to position the second edge surface adjacent the first edge surface, step (d) being performed before step (c).

2. The method as claimed in claim 1, step (d) comprising the step of cutting the removed part off of the remaining part of the another layer.

3. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers; and (d) trimming a width of the second layer to provide a frictional fit between the layers when the second layer is positioned within the groove, step (d) being performed before step (b).

4. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers, step (a) comprising the step of dado cutting a substantially rectangular groove.

5. The method as claimed in claim 4, step (a) including the step of spinning a dado-cutting blade at a rotational speed of about 1400 rpm.

6. The method as claimed in claim 5, step (a) including the step of feeding the one stone layer along the blade at a feed speed of about 8 meters per hour.

7. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers, step (b) including the step of adhering the layers to one another.

8. The method as claimed in claim 7, said adhering step wherein each of the layers presents respective bonding surfaces that are opposed to each other, with adhesive being applied to each bonding surface.

9. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers, step (c) including the step of machining a margin profile along a longitudinal edge of the finished layered edge surface, with the profile being substantially uniform along the longitudinal edge.

10. The method as claimed in claim 9, step (c) further including the step of polishing the finished layered edge surface.

11. The method as claimed in claim 3, step (b) including the step of frictionally fitting the second layer within the groove of the first layer.

12. The method as claimed in claim 1, after step (b) and prior to step (d), said second layer including an excess part that projects outwardly from an unfinished exterior edge surface of the first layer, step (d) including the step of cutting the excess part of the second layer from the inlaid margin to form a substantially flat edge surface of the secured stone layers.

13. The method as claimed in claim 12, step (d) including the step of cutting part of the first layer from the inlaid margin after securing the second layer within the groove to form the substantially flat edge surface of the secured stone layers.

14. The method as claimed in claim 1; and (e) machining the second layer to have a depth greater than the depth of the groove formed in step (a).

15. A method of manufacturing an inlaid stone composite having at least two stone layers, said method comprising the steps of:

(a) forming a longitudinally extending groove in a first one of the stone layers with a dado-cutting device, with the groove extending inwardly between adjacent first edge surfaces of the first stone layer;

(b) securing a second one of the stone layers within the elongated groove to form an inlaid margin that includes the layers, with the second layer presenting a second edge surface positioned between the adjacent first edge surfaces;

(c) after steps (a) and (b), machining the adjacent first edge surfaces and second edge surface at the same time in a single milling pass with a milling device to remove part of the margin and thereby form a longitudinally extending finished layered edge surface cooperatively defined by the machined layers;

(d) forming a second longitudinally extending groove in at least one of the stone layers, with the groove extending inwardly from the corresponding edge surface of the at least one stone layer; and (e) securing a third one of the stone layers within the second groove so that the third stone layer forms part of the inlaid margin.

16. The method as claimed in claim 15, step (c) being performed after steps (d) and (e) so that the first, second, and third secured layers are machined at the same time to remove part of the margin and thereby form the longitudinally extending finished layered edge surface.

17. The method as claimed in claim 15, step (d) including the step of forming the second groove substantially parallel to the first-mentioned groove.

18. The method as claimed in claim 15, step (d) including the step of forming the second longitudinally extending groove with the dado-cutting device.

* * * * *